US005244293A

United States Patent [19]

Ludger et al.

[11] Patent Number: 5,244,293

[45] Date of Patent: Sep. 14, 1993

[54] METHOD FOR POSITIONING WEB-SHAPED RECORDING SUBSTRATES IN PRINTING DEVICES

[75] Inventors: Alfs Ludger, Munich; Franz Kristen, Puchheim, both of Fed. Rep. of Germany

[73] Assignee: Mannesmann Aktiengesellschaft, Düsseldorf, Fed. Rep. of Germany

[21] Appl. No.: 945,864

[22] Filed: Sep. 16, 1992

Related U.S. Application Data

[63] Continuation-in-part at PCT/DE 91/00204, filed Mar. 6, 1991.

[30] Foreign Application Priority Data

Mar. 16, 1990 [EP] European Pat. Off. ..... 90105030.02

[51] Int. Cl.[5] ..... B41J 11/26

[52] U.S. Cl. ..... 400/611; 400/616; 400/616.3; 364/471; 364/737; 364/571.02; 226/6; 226/2; 226/28; 226/143; 250/571; 250/559

[58] Field of Search ..... 400/611, 578, 579, 616, 400/616.1, 616.2, 616.3; 364/471, 737, 571.02; 226/1, 2, 45, 6, 28, 34, 42, 43, 143; 250/571, 559

[56] References Cited

U.S. PATENT DOCUMENTS

| | | | |
|---|---|---|---|
| 3,949,856 | 4/1976 | Ulber | 400/579 |
| 4,485,949 | 12/1984 | Gebhart et al. | 226/2 |
| 4,577,849 | 3/1986 | Watanabe | 271/9 |
| 4,807,790 | 2/1989 | Ushioda et al. | 226/2 |
| 4,998,835 | 3/1991 | Negishi et al. | 400/611 |
| 5,043,904 | 8/1991 | Sikes et al. | 226/1 |
| 5,061,096 | 10/1991 | Hauslaib ete al. | 400/616.2 |
| 5,072,414 | 12/1991 | Buisker et al. | 226/45 |

FOREIGN PATENT DOCUMENTS

| | | |
|---|---|---|
| 3819848 | 1/1989 | Fed. Rep. of Germany . |
| 3824108 | 1/1989 | Fed. Rep. of Germany . |
| 88/00530 | 1/1988 | PCT Int'l Appl. . |

*Primary Examiner*—Eugene H. Eickholt
*Attorney, Agent, or Firm*—Horst M. Kasper

[57] ABSTRACT

An occurring positioning error is electronically corrected during the positioning of edge-perforated continuous form paper (10) in a print position (PP) relative to a print station (13) of a printing device (1). Edge perforation holes (EH1 . . . EHv) on the continuous form paper (10) are scanned for the electronic correction and the positioning error is determined for a block (B1 . . . Bm . . . Bu) of the continuous form paper (10). The positioning error is composed in this case for each block (B1 . . . Bm . . . Bu) of at least one slippage value (Sv−1, Sv) as well as of a residual error (RE1 . . . REm . . . REu). While the slippage value (SVv−1, SVv) for a block (Bm) is corrected immediately, a residual error (REm) is taken into consideration during the correction of the position error for a next following block (Bm+1). In addition to the electronic correction of the positioning error, determined for the block (B1 . . . Bm . . . Bu), the positioning process is surveyed relative to interventions (I). If for example an intervention (I) is determined during the positioning of the single block (Bm), then the positioning error is determined anew.

17 Claims, 14 Drawing Sheets

METHOD FOR POSITIONING WEB-SHAPED RECORDING SUBSTRATES IN PRINTING DEVICES

CROSS-REFERENCE TO RELATED APPLICATIONS

This application is a continuation-in-part application of another international application filed under the Patent Cooperation Treaty Mar. 6, 1991, bearing Application No. PCT/DE91/00204, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a method for the positioning of web-shaped recording substrates in printing devices.

2. Brief Description of the Background of the Invention Including Prior Art

If a movable, web-shaped recording substrate which exhibits scannable elements is to be precisely positioned in a printing device, for example in an ink jet printer, in a thermal transfer printer, in a dot pin printer, and in a laser printer, relative to a print station, then the drive device, responsible for the positioning, has to be laid out and constructed correspondingly in order to avoid positioning errors. Tolerances in the drive device are predominantly the cause for the positioning errors, where the reached target position of the movable, web-shaped recording substrate, exhibiting scannable elements, deviates from the desired position. If the language relates in the following to a web-shaped recording substrate, then this designates a recording substrate, where the recording substrate can differ both in the kind (for example paper, cardboard, foil) as well as in the kind of the scannable elements, for example edge perforation hole, dash-code-like or bar-code-like stripe.

A typical application situation for this case is present in particular in the case of the transport of edge-perforated continuous form paper in printing devices, where the continuous form paper is fed by a transport device of a print station driven by an electromotor. The transport device, driven by an electromotor, comprises here a platen, driven by an electromotor, and pin-feed tractor wheels, which engage into the edge perforation of the continuous form paper. Based on the tolerances of the feed mechanism of an electromotor of the transport device, of the platen as well as of a slippage occurring between the platen and the continuous form paper in connection with a friction drive, the position to be headed for and reached of the continuous form paper shifts with each advance, relative to the upper edge of the continuous form paper, more and more away from the desired position. The therewith associated continuous increase of the positioning error has only an insignificant influence in case of a single sheet because of the smaller paper length in contrast to the continuous form paper. In case of printing on continuous form paper, the positioning error has therefore to be compensated. The positioning error becomes increasingly noticeable and visible, in particular where the continuous form paper is a printed blank form paper.

A mechanical paper tractor is known from the German printed patent document DE-A1-3,819,848, where for example a pin-feed tractor wheel, disposed on one side and driven by a motor, engages into the edge perforation of the continuous form paper for the transport of continuous form paper. If the pin-feed tractor wheel, coupled with the motor, for example a step motor, is driven with a drive shaft, then the continuous form paper is advanced and thereby moved over a platen past a print head. Very small tolerances are required in the mechanics of the known mechanical tractor in order to maintain the positioning error as small as possible. In addition, the mechanical paper tractor is associated with the disadvantage that a deviation, occurring based on the tolerances between the reached print position and the desired position, cannot be compensated.

Signals are given to an automatic control device, based on which the advance of the continuous form paper can be automatically controlled. In an exemplified embodiment of the device or, respectively, of the method, the distance between two neighboring edge perforation holes is determined for generating the signal given to an automatic control device, wherein the number of motor steps, determined for the path distance covered between two edge perforation holes during the relative motion of the continuous form paper relative to the optoelectronic scanning device, is compared to a theoretical number of motor steps. Dependent on this comparison result, a positioning error of the continuous form paper, resulting from the discrepancy between the actual and theoretical number of motor steps within a perforation hole distance during the relative motion of the continuous form paper relative to the optoelectronic scanning device, is corrected immediately upon surpassing a preset value. In addition, a number of motor steps is determined at the start of the edge perforation hole scanning of the continuous form paper, wherein said number of motor steps corresponds to the deviation of the optoelectronic scanning device based on a start position of the continuous form paper during the edge perforation hole scanning. The determined number of motor steps is again taken into consideration after scanning the edge perforation holes belonging to one sheet of the continuous form paper.

A transport device including a thrust tractor pair is disclosed in U.S. Pat. No. 5,061,096, where the thrust tractor pair is disposed in transport direction in front of a substrate support and is furnished with at least one driven gear wheel.

A drive mechanism for advancing paper in printing apparatus is shown in U.S. Pat. No. 4,577,849 to Watanabe.

A system for transporting web-shaped recording substrates in printing devices is disclosed in copending United States continuation-in-part-application to PCT application PCT/DE91/00197 filed Mar. 1, 1991.

SUMMARY OF THE INVENTION

Purposes of The Invention

It is an object of the present invention to provide a method for the positioning of web-shaped recording substrates in printing devices, wherein one movable web-shaped recording substrate, exhibiting scannable elements and driven by an electromotor-driven transport device, can be positioned simply and economically under consideration of occurring positioning errors, as well as independent of interventions during a positioning process of the recording substrate.

These and other objects and advantages of the present invention will become evident from the description which follows.

Brief Description of the Invention

The present invention provides a method for positioning web-shaped recording substrates in a printing device. Web-shaped recording substrates are employed including scannable elements. The scannable elements are disposed at preset distances relative to each other. The web-shaped recording substrate is moved in the printing device. The scannable elements are guided past a scanning device during a motion of the web-shaped recording substrate. A scanning signal is generated in the scanning device related to a motion of scannable elements on the web-shaped recording substrate in the printing device. The scanning results are collected with means for collecting scanning results. Said means for collecting scanning results are connected to the scanning device. Drive steps of the electromotor drive are collected. A plurality of scannable elements are combined to form a signal block. The scanning results are compared with preset values of an element storing reference points in a comparison device connected to the means for collecting scanning results. Corrections of positioning errors encountered are determined with means for performing corrections connected to the comparison device and connected to an automatic control circuit of an electromotor-driven transport device for the web-shaped recording substrate. Corrections of positioning errors encountered are quantized at an end of a signal block with a residual error remaining in general. A position of the web-shaped recording substrate is corrected block by block with the automatic control circuit. A residual error is entered with proper sign into a subsequent correction procedure.

The blockwise automatic control can occur with the following steps. A reference position can be determined for blocks of the recording substrate. A position of at least one scannable element relative to the position of the scanning device can be collected at the beginning of an automatic position control of the recording substrate for each block. A position of at least one scannable element relative to the position of the scanning device can be collected for determining at least one set/actual position deviation of the recording substrate relative to a reference position of the signal blocks causing the positioning error. A position of the recording substrate for the blocks can be determined depending on the set/actual position deviation of the recording substrate for correcting the position of the recording substrate. A set/actual comparison of the respective, scanned path can be performed during a positioning of the recording substrate in the printing device. The reference position of the signal blocks can be shifted during an automatic control of the position of the recording substrate. The position of two scannable elements of the signal blocks of the recording substrate relative to the position of the scanning device can thereby be cyclically collected for determining, setting, and considering interventions.

A reference point indicating a position of the scannable element relative to a position of the scanning device can be searched at the beginning of the blockwise automatic position control of the recording substrate within a preset distance of the scannable elements starting with a first scannable element. It can be investigated if a tolerance region value of the scannable element is falling below or, respectively, is surpassed based on a reference point of the scannable element being recognized within a preset distance by the scanning device. The method steps of searching and investigating for the signal block depending of the results of investigating can be repeated for such time until the tolerance region for the scannable elements is no longer falling below or, respectively, is no longer surpassed. A relative shifting of the recording substrate relative to the scanning device can be determined at the beginning of the blockwise automatic position control of the recording substrate up to the reference point. A reference position referring to the reference point can be defined for the case that the tolerance region for the scannable elements is no longer falling below or,.respectively, is no longer surpassed.

An upper edge of the scannable element can be defined as a reference point.

A recording substrate can be moved relative to the printing device with a relative motion for determining the set/actual position deviation relative to the scanning device by a predetermined value from the reference position up to a starting point by theoretical evaluation windows into a transport direction of the recording substrate. The recording substrate can be moved further from a starting point up to an end point into the transport direction relative to the scanning device. A scannable element can be searched within a theoretical evaluation window. The relative shifting of the recording substrate relative to the scanning device can be compared with a theoretical set/actual position deviation.

A set/actual position deviation can be determined for a last scannable element of the blocks. The set/actual position can be employed in case of a presence of a plurality of set/actual position deviations for a correction of the position of the recording substrate.

A residual error of the signal blocks, not considered in the set/actual position deviation and causing the position error, can be added to the set/actual position deviation during the correction of the position of the recording substrate.

A residual error of a signal block can be determined by comparing a relative shifting of the recording substrate relative to the scanning device for a subsequent signal block from a reference position to a reference point of the scannable elements with the relative shifting of the recording substrate relative to the scanning device for the signal block from a reference position to a reference point of the scannable elements.

A printing device including positioning of web-shaped recording substrates includes a pin-feed tractor wheel having pins for engaging edge-perforated continuous paper including scannable elements. The scannable elements are disposed at preset distances relative to each other. Free-wheeling drive rollers are disposed adjacent to a printer platen for forming a roller wedge for receiving edge-perforated continuous paper delivered by the pin-feed tractor wheel. A scanning device is disposed such that the guided edge-perforated continuous paper passes with the scannable elements past the scanning device during a motion of the edge perforated continuous paper. A signal generator is associated with the scanning device for generating a scanning signal related to a motion of the scannable elements on the edge-perforated continuous paper. Means for collecting scanning results are connected to the scanning device. An automatic control circuit is connected to an electromotor powered drive. Means are provided for collecting drive steps of the electromotor powered drive and an element is provided for storing reference points. Means are furnished for forming a signal block by combining a plurality of scannable elements connected to the means for collecting scanning results. A comparison device is connected to the element storing reference points and to the means for forming a signal block for comparing scanning results with preset values of the element storing reference points. Means for performing corrections are connected to the comparison device for determining corrections of positioning errors encountered for quantizing corrections of positioning errors encountered at an end of a signal block with a residual error remaining in general and connected to the automatic control circuit and for correcting a position of the edge-perforated continuous paper block by block through the automatic control circuit and for using a residual error with proper sign in a subsequent correction procedure.

A positioning error is electronically corrected in the context of the positioning of a movable, web-shaped recording substrate exhibiting scannable elements, for example of an edge-perforated, web-shaped fanfold paper in a printing device. Mechanical tolerances of a transport device, driven by an electromotor, are the cause for the positioning error, for example, tolerances and defect errors of an electromotor, tolerances of a platen, as well as slippage occurring between the edge-perforated fanfold paper and the platen. In addition, some of these tolerances are dependent on temperature. A simplified construction of the electromotor transport device as well as a larger positioning accuracy of the recording substrate to be positioned result from the electronic correction of the positioning error.

The platen is preferably provided as a friction roller platen in order to be able to transport the web-shaped recording substrate in a simple way without increased mechanical construction requirements. A paper guide device is required based on the friction drive of the web-shaped recording substrate. The paper guide device transports for example edge-perforated continuous form paper with a pin-feed tractor wheel, which is driven by an electromotor and which can be decoupled from the transport device, at a precise position into a roller wedge of the transport device and laterally guides the continuous form paper during the friction drive.

The scannable elements, formed as edge perforation holes, allow a simple scanning, where an optical scanner delivers a signal for a paper - edge perforation hole transition or, respectively, an edge perforation hole - paper transition, where the positioning error is determined with the signal. Preferably, a microprocessor is employed for this determination, wherein the microprocessor automatically controls the position of the recording substrate dependent on the signal and by taking into consideration the occurring positioning errors. The use of the microprocessor is furthermore associated with the advantage that interventions can be surveyed such as, for example, user interventions, paper jamming, scanning errors or, respectively, paper errors, more than one successively covered edge perforation hole during the scanning of the recording substrate, or set/actual point position deviations of the recording substrate which deviations are too large over a predetermined partial length section of the recording substrate and which deviations result in a surpassing of the tolerance of the positioning error. The surveillance assures that despite the intervention the positioning error can be corrected.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
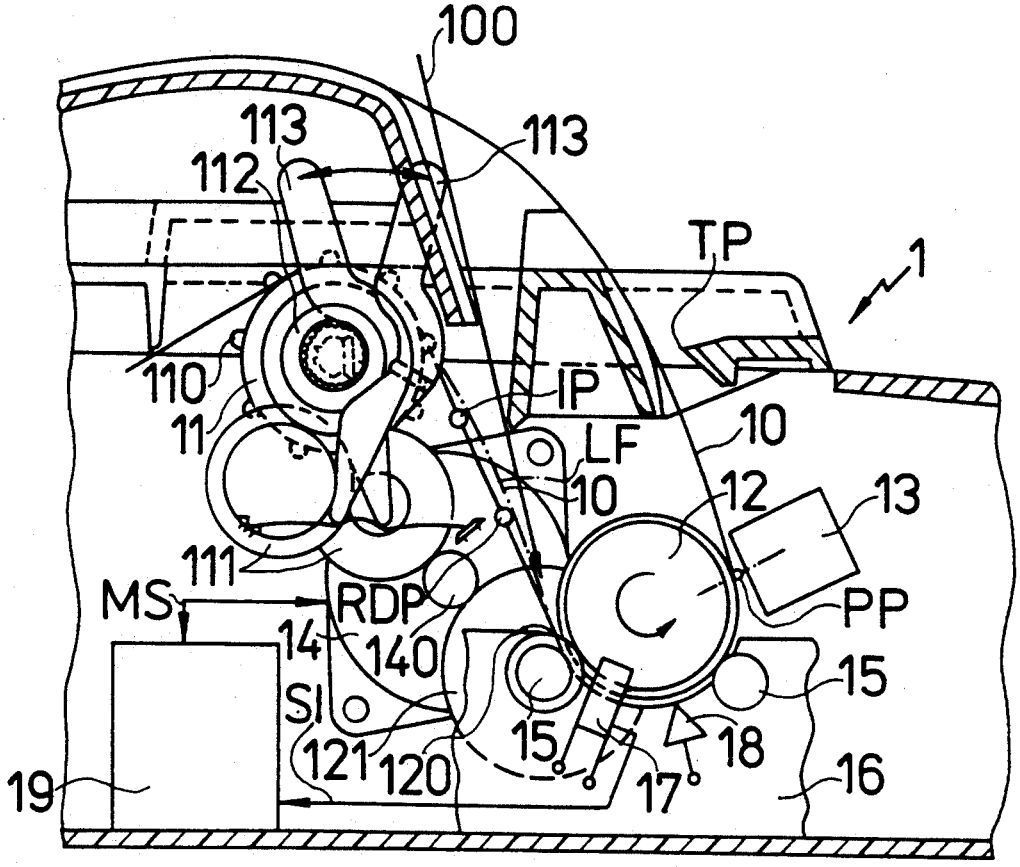
FIG. 1 is a schematic side elevational view of a principle construction of a printing device for edge-perforated continuous form paper.

FIG. 1 illustrates a principle construction of a printing device 1, wherein an edge-perforated continuous form paper 10 is brought into a print position PP in the region of a print station 13 with a pin-feed tractor wheel 11 and a platen 12. The transport of the continuous form paper 10 is thereby subdivided into two sections as follows:

According to a first transport section, the continuous form paper 10 is transported up to a roller wedge 120 by the pin-feed tractor wheel 11 with pins 110, engaging into the edge perforation of the continuous form paper 10. The pin-feed tractor wheel 11 is connected with a first gear 111 to a drive pinion 140 of an electromotor 14, for example a step motor or a DC motor for this purpose. Alternatively, it is however also possible to transport the continuous form paper 10 manually into the roller wedge 120 by rotation of a handwheel, coupled to the pin-feed tractor wheel 11.

Subsequently, the continuous form paper 10 is further transported in a second transport section from the platen 12 into the print position PP. The platen 12 is driven for this purpose also by the electromotor 14 with the drive pinion 140 and a second gear 121 in the arrow direction shown in the drawing, downward in FIG. 1. The platen 12 with free wheeling drive rollers 15 forms the roller wedge 120 in a paper deflection area 16 for the transport of the edge-perforated continuous form paper 10. Based on the roller motion between the platen 12 and the free wheeling drive rollers 15, the continuous form paper 10 is transported based on friction and is led past an optical scanner 17, a mechanical scanner 18, and the print station 13. While the mechanical scanner 18 determines if the paper is disposed between the platen 12 and the paper deflection area 16, the optical scanner 17 surveys and monitors the edge perforation of the continuous form paper 10.

In order for the optical scanner 17 to perfectly recognize the edge perforation, the edge-perforated continuous form paper 10 has to be inserted in a precise relative position into the roller wedge 120 with utmost precision. This is in particular necessary because no position-precise receiving of the continuous form paper 10 can occur during the transport receiving of the continuous form paper 10 by the platen 12 based on the friction-associated transport.

The pin-feed tractor wheel 11 also serves in this case as a guide device of the edge-perforated continuous form paper 10 up to the roller wedge 120. The pin-feed tractor wheel 11 guides the continuous form paper 10 position-precise into the roller wedge 120 based on the continuous engagement of the pins 110 into the edge perforation.

If, on the other hand, no edge-perforated continuous form paper 10 is to be printed, then the guide device is to be constructed, for example, as a guide channel with laterally disposed guide rails.

In contrast to a mechanical tractor, where also during the further transport of the continuous form paper 10 with the platen 12 the pin-feed tractor wheel 11, like the platen 12, is mechanically coupled continuously to the electromotor 14, the pin-feed tractor wheel 11 according to FIG. 1 is decoupled for this transport section from the drive of the platen 12.

This is achieved according to the patent application by a suitable selection of the gears 111, 121 and a switch coupling 112. The gear translations are in this case selected such that the platen 12 rotates slightly faster than the pin-feed tractor wheel 11. The continuous form paper 10 is thereby transported between the pin-feed tractor wheel 11 and the platen 12 to the print position PP without a loop formation LF. The switch coupling 112, preferably provided as a tooth coupling, exhibits two coupling gearings, not shown in FIG. 1, which are engaging each other against a spring force, where the coupling gearings are matched relative to the teeth subdivision such to each other that the following operating modes of the printing device 1 are performed function-assured in case of the predetermined gear translations:

(a) positive-contact advance of the continuous form paper 10 from an insertion position IP or a ready position RDP of the continuous form paper 10 up to the roller wedge 120, (b) advance of the continuous form paper 10 to the print position PP with the platen 12, where the pin-feed tractor wheel 11 is decoupled from the drive of the platen 12 and is moved with the continuous form paper 10 transported with the platen 12, (c) non-positive-contact reverse transport of the continuous form paper 10 from a tear-off position TP into the print position PP or into the ready position RDP in order to be able to print an individual sheet 100 in the meantime, and (d) individual-sheet operation of the printing device 1, wherein the coupling gearing of the switch coupling 112 is brought out of engagement by actuation of an operating lever 113.

Positioning errors can occur based on the friction-induced transport of the paper which have to be corrected.

This is not possible because of the continuous coupling between the pin-feed tractor wheel and the platen in connection with the mechanical tractor. In order to maintain a possibly occurring positioning error nevertheless as small as possible, the tolerances in the mechanical coupling between the platen and the pin-feed tractor wheel are to be maintained as small as possible.

In contrast to the mechanical tractor, the position-precise further transport of the continuous form paper 10 is achieved with an automatic control device 19, connected to the electromotor 14 and the optical scanner 17, for the printing device 1 according to FIG. 1. The automatic control device 19, formed for example by a microprocessor, clones and imitates for this purpose electronically the behavior of the mechanical tractor and thereby represents an electronic tractor. If the optical scanner 17 registers a paper - perforation hole change or, respectively, a perforation hole - paper change during the paper advance, then the optical scanner 17 delivers a signal SI, corresponding to the change, to the microprocessor 19. The number of motor steps MS of the electromotor 14 are determined by the microprocessor 19 parallel to the changes of the paper - perforation hole and perforation hole - paper, which number of motor steps MS are required by the electromotor 14 to advance the continuous form paper 10 for a predetermined distance. A typical value for the motor step MS is for example 1/120 inch or 0.211 mm.

The microprocessor 19 performs with the received data SI, MS a position surveillance or, respectively, a position evaluation of the continuous form paper 10 relative to the optical scanner 17 and automatically controls the electromotor 14 depending on a slippage value, determined during the position surveillance or, respectively, the position evaluation. The slippage value results in this case from a deviation between a determined actual position and a set position of the continuous form paper 10. The edge perforation of the continuous form paper 10 serves in this case as a measure for the position surveillance or, respectively, the position evaluation, wherein the edge perforation of the continuous form paper 10 is scanned by the optical scanner. The slippage value corresponds thereby to the positioning error of the continuous form paper 10 in the printing device 1 with the exception of a possibly still to be considered residual error.

Figure 2:
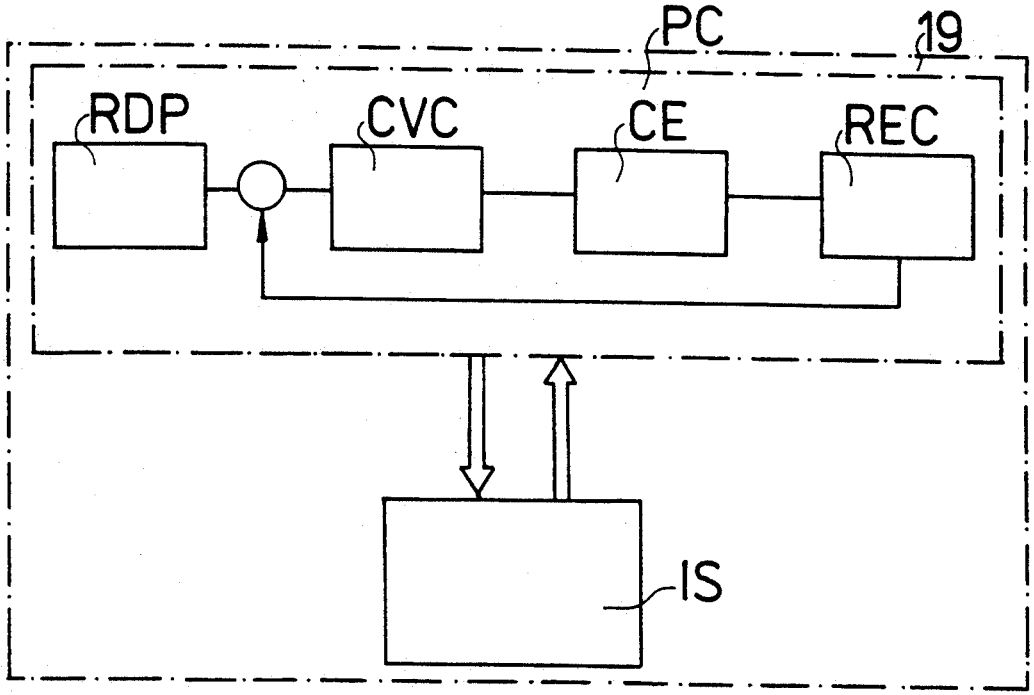
FIG. 2 shows a schematic block circuit diagram of a paper correction plane and an intervention surveillance plane of a microprocessor according to FIG. 1.

FIG. 2 shows two parallel acting and mutually interacting function planes of the microprocessor 19 in a block circuit diagram, where the position surveillance or, respectively, the position evaluation of the continuous form paper 10 is performed block by block in the printing device 1 on the two function planes of the microprocessor 19. A block B1 . . . Bm . . . Bu with m, u as index variable and m=1 . . . u corresponds in this case to a partial length section of the continuous form paper 10, for example, for a web-shaped fanfold paper of the length of an individual sheet. The procedures performed and running for the position surveillance or, respectively, the position evaluation are composed in this case of a paper correction PC and an intervention surveillance IS.

The paper correction PC, which is composed out of four function blocks, a reference point definition RPD, a correction value collection CVC, a correction execution CE, and a residual error collection REC, is constructed as an automatic control circuit for the position surveillance or, respectively, the position evaluation. This automatic control circuit is passed through one time for each block B1 . . . Bm . . . Bu of the continuous form paper 10. After the reference point definition RPD, the slippage value is determined in the correction value collection CVC, is corrected in the correction execution CE, and the residual error is determined in the residual error collection REC. The determined residual error is in this case considered only during the position surveillance or, respectively, the position evaluation of the subsequent block.

In order to be able to perform the paper correction PC and the intervention surveillance IS, the continuous form paper 10 has to be edge-perforated or has to be marked in another manner. In addition, each block B1 ... Bm ... Bu or, respectively, partial length section of the continuous form paper 10 has to exhibit a minimum length of three edge perforation hole distances or, respectively, 9/6", wherein the distance from a first edge perforation hole to a second edge perforation hole amounts to 3/6", thereby resulting in a total of 9/6" or 1½" for three distances between holes. In case of blocks B1 . . . Bm . . . Bu or, respectively, partial length sections, which are not an integral multiple of the distance between two neighboring perforation holes, the correction value collection CVC of the paper correction PC refers to the next smaller subdividable length of the blocks B1 . . . Bm . . . Bu or, respectively, of the partial length section. The residual error, determined during the residual error collection REC, becomes thereby larger. The blocks B1 . . . Bm . . . Bu or, respectively, the partial length sections, which are larger than three edge perforation hole distances, can be traced as a limiting value to the smaller permissible length for the blocks B1 . . . Bm . . . Bu or, respectively, the partial length sections.

The paper correction PC of the microprocessor 19 is started for example during print initiation, if the edge-perforated continuous form paper 10 is disposed in the print position PP according to FIG. 1 for the printing of a first line. In addition, a start position SP1 . . . SPm . . . SPu can be given for each block B1 . . . Bm . . . Bu with reference to the optical scanner 17, wherein the starting position serves as a reference position for the position surveillance or, respectively, the position evaluation.

Figure 3:
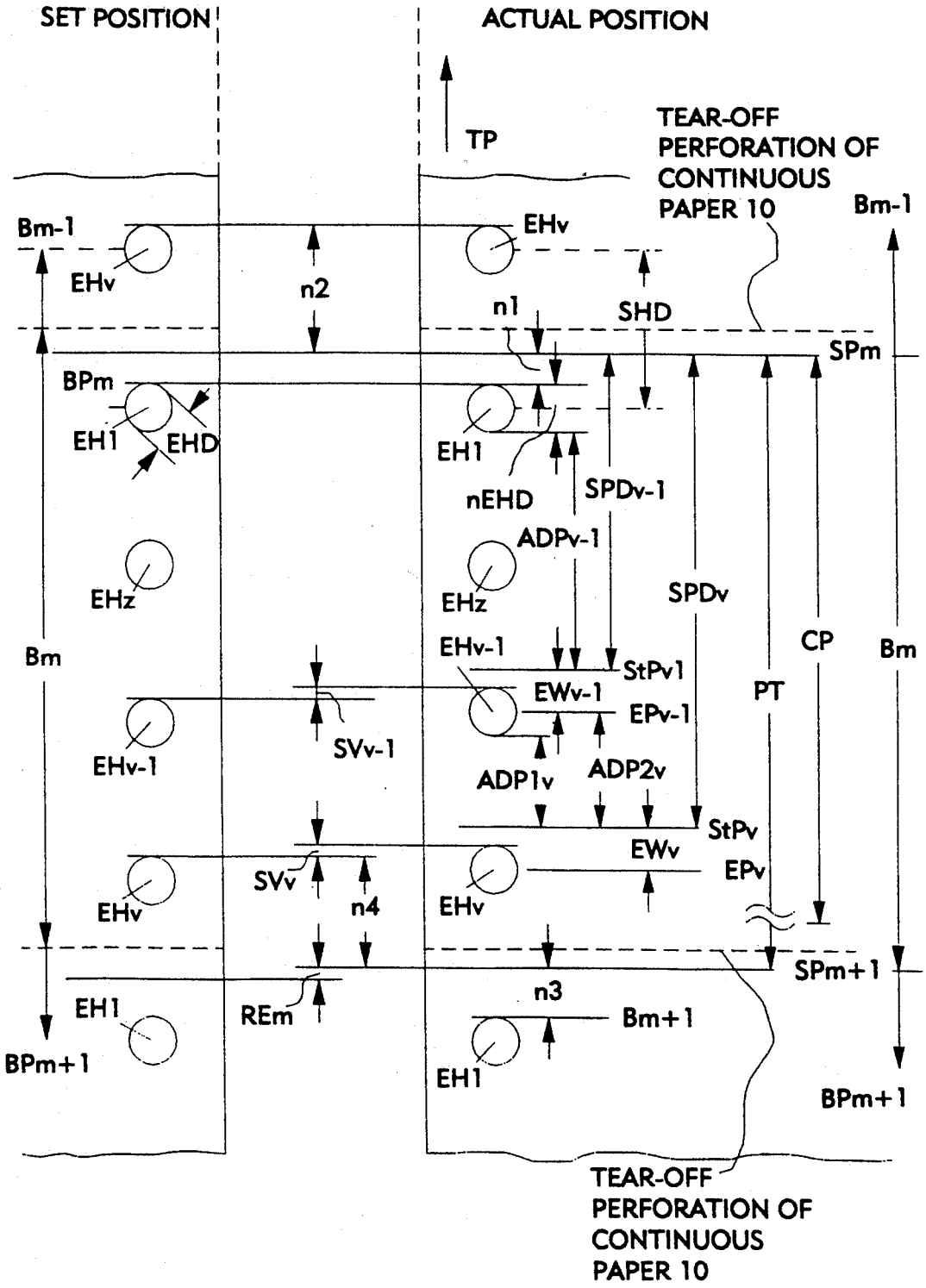
FIG. 3 shows a diagram illustrating the course of the microprocessor-controlled paper correction based on a comparison between a set position and an actual position of the continuous form paper in the printing device.

It is shown in FIG. 3 for an arbitrary block Bm how the position surveillance or, respectively, the position evaluation runs its course in detail. The start position SPm, belonging to the block Bm, is distanced by a pointer P from a next following starting position SPm+1 of a next following block Bm+1, where the length of the pointer P corresponds to the length of the block B1 . . . Bm . . . Bu of the continuous form paper 10.

The position surveillance or, respectively, the position evaluation starts with initially determining a reference point RPm for the block Bm, for example a first block B1, in connection with a reference point definition RPD. The determination of the reference point RPm is performed in that an edge perforation hole EH1 . . . EHv, distanced in transport direction TD of the continuous form paper 10 from the starting position SPm, and with v as further index variable for a predetermined path distance of the continuous form paper 10, must be recognized within the block Bm during the stepwise further transport of the continuous form paper 10 with the platen 12. If this is not the case, for example for a first edge perforation hole EH1, disposed next to the starting position SPm, because either a) the edge perforation hole EH1 does not belong to and is not an element of the edge perforation hole EH1 . . . EHv of the continuous form paper 10, or (b) the predetermined path distance of the continuous form paper 10 has already been covered without a paper - perforation hole change of the optical scanner 17 being communicated, then in both cases the continuous form paper 10 is scanned up to a next following edge perforation hole EH2. This process is repeated until an edge perforation hole EHz of the edge perforation holes EH1 . . . EHv, belonging to the block Bm, is recognized by the optical scanner 17. The edge perforation hole EHz is the last possible edge perforation hole which can be taken into consideration for the reference point definition RPD. The edge perforation hole EHz is for example the third to the last edge perforation hole for the present case according to FIG. 3. This can be explained from the fact that at least one edge perforation hole, in the present case for example a next to last and last edge perforation hole EHv−1 or, respectively, EHv, is required for the correction value collection CVC.

It is now presumed in the following that the first edge perforation hole EH1 of the block Bm has been recognized as such by the optical scanner 17. For this purpose, the continuous form paper 10 is moved from the starting position SPm by a number n1 of motor steps MS of the electromotor 14 in the transport direction TD according to FIG. 3. The reference point RPm, corresponding to the number n1 of motor steps MS, coincides thereby with the upper edge of the first edge perforation hole EH1. The starting position SPm as reference position for the paper correction PC of the block Bm is defined with reference to the reference point RPm by the number n1 of motor steps MS. The reference point RPm is now shifted by a set perforation hole distance SHD between two neighboring edge perforation holes in the upper edge of a preceding edge perforation hole, which is in the present case the last edge perforation hole EHv of a block Bm−1. It is also possible to allow the reference point RPm to coincide with the lower edge of the edge perforation hole EH1. Accordingly, the reference point RPm would then also be shifted by the set perforation hole distance SHD into the lower edge of the preceding edge perforation hole EHv of the block Bm−1. A number n2 of motor steps MS, resulting from the shifting, is defined as standard with the reference point definition RPD for the next following blocks Bm+1 . . . Bu of the continuous form paper 10 and is stored by the microprocessor 19. The intervention surveillance IS in the microprocessor 19 is initialized and started and the correction value collection CVC of the paper correction PC is also performed simultaneously with the storing of the standard.

The intervention surveillance IS of the microprocessor 19 has the object to capture interventions which occur during the transport of the continuous form paper 10 to the print station 13 in the print position PP and to adapt the paper correction PC to these interventions.

If interventions are registered by the intervention surveillance IS during the correction value collection CVC, for example in the case that, based on the intervention, the reference point RPm is disposed remote within a set perforation hole distance SHD from the lower edge of the last edge perforation hole EHv and that thereby a correction or, respectively, a compensation of the positioning error is no longer possible for the block Bm of the continuous form paper 10, then the starting points StPv−1, StPv for the correction value collection CVC are shifted by a set perforation hole distance SHD. In addition, all slippage values, determined up to now during the correction value collection CVC, are marked as not usable. Interventions thus have the consequence that the residual error part of the positioning error becomes larger. By definition, an intervention is always present then where the microprocessor 19 determines tolerance surpassings in the deviation between the set position and the actual position of the continuous form paper 10 in the printing device 1 through the optical scanner 17 during the block-wise performed positioning surveillance or, respectively, positioning evaluation.

Figure 4:
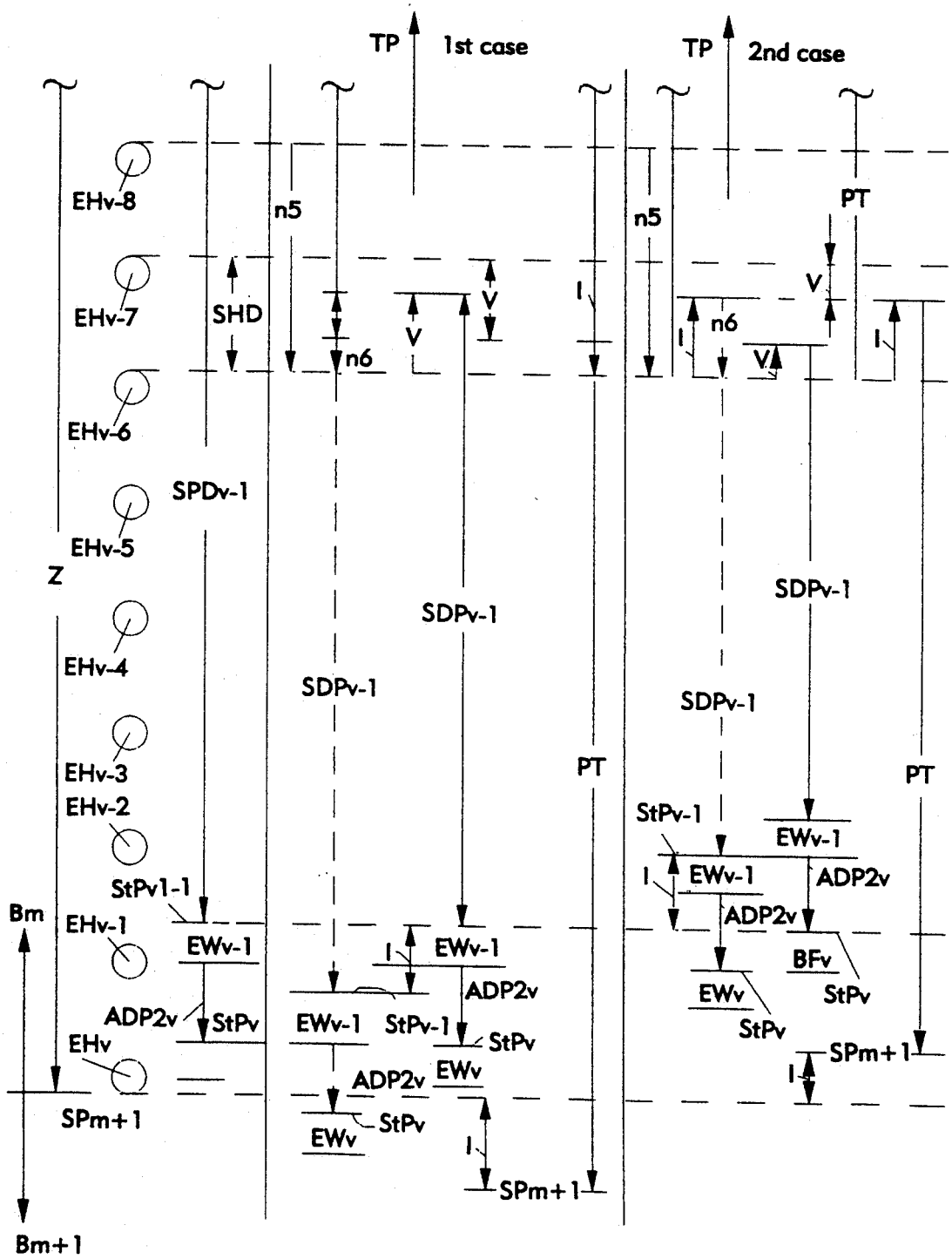
FIG. 4 shows a view of a pointer diagram for an intervention in advance and reverse direction.

This can for example be the case where a) an operating person changes the advance of the continuous form paper 10 by rotation of the platen 12 or, respectively, by pulling at the continuous form paper 10 during the position surveillance or, respectively, position evaluation of the continuous form paper 10 in the printing device 1, b) the continuous form paper 10 is jammed in the printing device 1, c) more than one successive edge perforation hole EH1 . . . EHv is not recognized as such by the optical scanner 17 for each block B1 . . . Bm . . . Bu, d) scanner errors or paper errors occur, and e) the slippage value determined for the respective block B1 . . . Bm . . . Bu is too large between the set position and the actual position of the continuous form paper 10. The description of FIG. 4 illustrates how the intervention surveillance IS is performed in detail.

The correction value collection CVC of the paper correction PC starts when the continuous form paper 10 has been moved since the printing start from the starting position SPm to a first starting point StPv−1 by a first set distance pointer SDPv−1 in the transport direction TD. In the case that the first edge perforation hole EH1 has been recognized as such by the optical scanner 17, the set distance pointer SDPv−1 is in this connection composed by an actual distance pointer ADPv−1, by a number nEHD of motor steps MS for the covering of an edge perforation hole diameter EHD, and by the number n1 of motor steps MS for the covering of the distance path between the starting position SPm and the reference point RPm. A first theoretical evaluation window EWv−1 is preset based on the first starting point StPv−1 and a first end point EPv−1, wherein the upper edge of the next to last edge perforation hole EHv−1 is expected for the correction value collection CVC within the first theoretical evaluation window EWv−1. A first slippage value SVv−1 is determined from the deviation between the set position and the actual position of the continuous form paper 10 if the optical scanner 17, moving relative to the continuous form paper 10, determines a paper - perforation hole change, corresponding to the edge perforation hole EHv−1, within the first evaluation window EWv−1.

However, if no paper - perforation hole change is determined within the first evaluation window EWv−1 or if the determined, first slippage value SVv−1 surpasses a theoretical slippage value, then the edge perforation hole EHv−1 is marked as not usable for the correction value collection CVC. The continuous form paper 10 is moved from the respective actual position by a second actual distance pointer ADP1v or, respectively, ADP2v in the transport direction TD up to a second starting point StPv after the first evaluation window EWv−1 or, respectively, the perforation hole diameter EHD of the edge perforation hole EHv−1 has been covered stepwise by the optical scanner 17.

The second starting point StPv is removed by a second set distance pointer SDPv from the starting position SPm. A second, theoretical evaluation window EWv is given by the second starting point StPv and a second end point EPv, within which a second, theoretical evaluation window EWv the upper edge of the last edge perforation hole EHv is expected for the correction value collection CVC. If the optical scanner 17, moving relative to the continuous form paper 10, determines also within the second evaluation window EWv a paper - perforation hole change belonging to the edge perforation hole EHv, then a second slippage value SVv is determined from the deviation between the set position and the actual position of the continuous form paper 10.

If, however, no paper - perforation hole change is determined within the second evaluation window EWv or if the determined, second slippage value SVv surpasses also the theoretical slippage value, then the edge perforation hole EHv is also marked as not usable for the correction value collection CVC. If this situation occurs, that both the next to last edge perforation hole EHv−1 as well as the last edge perforation hole EHv are marked as not usable for the correction value collection CVC, then the position of the continuous form paper 10 in the printing device 1 is not corrected for the block Bm. In this case, the continuous form paper 10 is further transported and advanced and at the point in time, where the distance path preset by the pointer P has been covered, and the paper correction PC is performed for a next following block Bm+1.

If, however, the slippage value SVv is valid for the last edge perforation hole EHv and/or the slippage value SVv−1 for the next to last edge perforation hole EHv−1, then the correction execution CE is started at a point in time where a path distance pregiven by a correction point CP has been covered with reference to the starting position SPm. According to FIG. 2, the slippage value SVv−1, SVv, determined for the block Bm during the correction value collection CVC, is taken into consideration for the correction execution CE and this slippage value SVv−1, SVv is updated at least during a two-time passage of the automatic control circuit for the paper correction PC by the amount of the residual error for the preceding block Bm−1, determined during the residual error collection REC. The correction execution CE is composed of two planes independent of each other. The correction is performed logically on a first plane. For this purpose, the pointer P is changed by a correction step number, resulting from the slippage value SVv−1, SVv or, respectively, the updated slippage value SVv−1, SVv.

The correction is performed physically on a second plane. It is initially attempted to incorporate the correction step number completely or in part into the actual advance command for the continuous form paper 10. If this is not completely possible, then an internal correction command is generated and started immediately for the leftover remainder at the end of the command. The last advance command is accepted only after the complete correction has been performed. The continuous form paper 10 is subsequently moved for the residual error collection REC for such a time in the transport direction TD after the acceptance of the last advance command until the distance path preset by the pointer P has been covered up to a starting position SPm+1 for the block Bm+1.

The residual error collection REC for the block Bm is in this case used simultaneously for the reference point definition RPD for the block Bm+1, wherein a reference point RPm+1 is defined analogously to the reference point RPm in connection with the reference point definition RPD for the block Bm.

It is to be assumed again according to FIG. 3 that the first edge perforation hole EH1 of the block Bm+1 has been recognized as such by the optical scanner 17. The continuous form paper 10 is for this purpose moved in the transport direction TD from the starting position SPm+1 by a number n3 of motor steps MS of the electromotor 14. The reference point RPm+1, corresponding to the number n3 of motor steps MS, coincides in this case with the upper edge of the first edge perforation hole EH1 of the block Bm+1. The reference point RPm+1 is now again shifted by the set perforation hole distance SHD into the upper edge of the last edge perforation hole EHv of the block Bm. A number n4 of motor steps MS, resulting from the shifting, is defined as new standard during the reference point definition RPD for next following blocks Bm+2 . . . Bu of the continuous form paper 10 and is stored by the microprocessor 19 in the case that an intervention has been determined by the intervention surveillance IS during the paper correction PC for the block Bm. During the residual error collection REC of the block Bm, a residual error REm is determined in that the number n3 of motor steps MS between the starting position SPm+1 and the reference point RPm+1 is subtracted from the number n1 of motor steps between the starting position SPm and the reference point RPm. The residual error REm, determined for the block Bm, is taken into consideration during the paper correction PC for the block Bm+1. The process described by way of FIG. 3 is repeated for such time until the printing process is terminated or if in the meantime an individual sheet is to be printed.

It is illustrated in FIG. 4 by way of a pointer diagram for a partial section of the block Bm from an edge perforation hole EHv−8 to the start position SPm+1 of the block Bm+1 at the lower edge of the last edge perforation hole EHv of the block Bm, how an intervention I opposite to and in transport direction TD of the continuous form paper 10 is recognized by the intervention surveillance IS of the microprocessor 19 and is taken into consideration during the paper correction PC of the microprocessor 19 according to FIG. 2. The number of motor steps MS between two edge perforation holes EH1 . . . EHv, for example an edge perforation hole EHv−7 and an edge perforation hole EHv−6, disposed at a set perforation hole distance SHD from each other, is continuously determined and evaluated in transport direction TD of the continuous form paper 10 during the intervention surveillance IS begun by the paper correction PC according to the reference point definition RPD. The upper edge of the edge perforation hole EH1 . . . EHv serves again as reference point as during the paper correction PC. However, it is also possible to employ the lower edge of the edge perforation hole EH1 . . . EHv as reference point.

The edge perforation holes, determined by the optical scanner 17 to be covered, are suppressed or, respectively, faded and shielded out analogously to the paper correction PC. The intervention surveillance IS is only terminated or, respectively, interrupted, when the starting position SP1 . . . SPm . . . SPu is newly defined (for example after paper end) or if an internal order opposite to the transport direction TD (asynchronous reverse direction) had to be generated for the correction execution CE of the paper correction PC. In the first case, the intervention surveillance IS is activated again by the paper correction PC. In the second case, the intervention surveillance IS searches for example automatically the upper edge of the next valid edge perforation hole EH1 . . . EHv to furnish synchronization and the intervention surveillance IS starts with the surveillance of the interventions I.

The intervention surveillance IS takes now the following course:

If the optical scanner 17 recognizes a paper - perforation hole change during the transport of the continuous form paper 10 in the printing device 1 for the transport direction TD, illustrated in FIG. 4, then there is checked, as in the case of the paper correction PC, if the recognized paper - perforation hole change belongs for example to the edge perforation hole EHv−8. If this is not the case, then there is further searched for the next paper - perforation hole change, belonging to the edge perforation hole EHv−7. Otherwise there is checked, whether the path distance, corresponding to a determined number of motor steps MS, and covered up to the edge perforation hole EHv−7, is disposed within the permissible tolerance for the set perforation hole distance SHD. If this is the case, then it is assumed that no intervention I was performed and the search for the next paper - perforation hole change, belonging to the edge perforation hole EHv−6 is continued.

Let us now assume that the edge perforation hole EHv−7 was not recognized by the optical scanner 17 and that thus the search for the next paper - perforation hole change, belonging to the edge perforation hole EHv−6, was continued. If the then recognized paper - perforation hole change belongs to the edge perforation hole EHv−6 and if the covered path distance, corresponding to a determined number n5 of motor steps MS, is outside of the permissible tolerance for the set perforation hole distance SHD, then an intervention I was performed. If under the recited assumption the number n5 is for example larger than a number nSHD of motor steps MS for the set perforation hole distance SHD, then either at least one edge perforation hole, for the present assumption the edge perforation hole EHv−7, was not recognized by the optical scanner 17 (second case according to FIG. 4), or an intervention I opposite to the transport direction TD was performed (first case according to FIG. 4). In both cases, the intervention I is derived from an intervention within a set perforation hole distance SHD. The same occurs if the number n5 is smaller based on an intervention I than the number nSHD of motor steps MS for the set perforation hole distance SHD.

However, instead of the number n5, only a number n6 of motor steps MS has been determined with reference to this set perforation hole distance SHD. In order to determine the size of the intervention I, the number n6 is decreased by the number nSHD of motor steps MS for the set perforation hole distance SHD. The thus determined value is a measure for the size of the recognized intervention I. Subsequently, the number n6 is subtracted from the number nSHD. The result provides a value V of motor steps MS by which the starting points StPv−1, StPv for the correction value collection CVC have to be shifted in order that the correction value collection CVC can again refer to a valid upper edge of an edge perforation hole. The value V is furthermore subtracted from the set distance pointer SDPv−1 for the correction value collection CVC. The starting points StPv−1, StPv for the correction value collection CVC migrate thereby upwardly by a set perforation hole distance SHD. In addition, all slippage values SVv−1, SVv, determined up to this point, are marked as not usable and the intervention surveillance is continued.

A course diagram of the paper correction PC, performed by the microprocessor according to FIG. 2, is illustrated in FIGS. 5 through 13.

Figure 5:
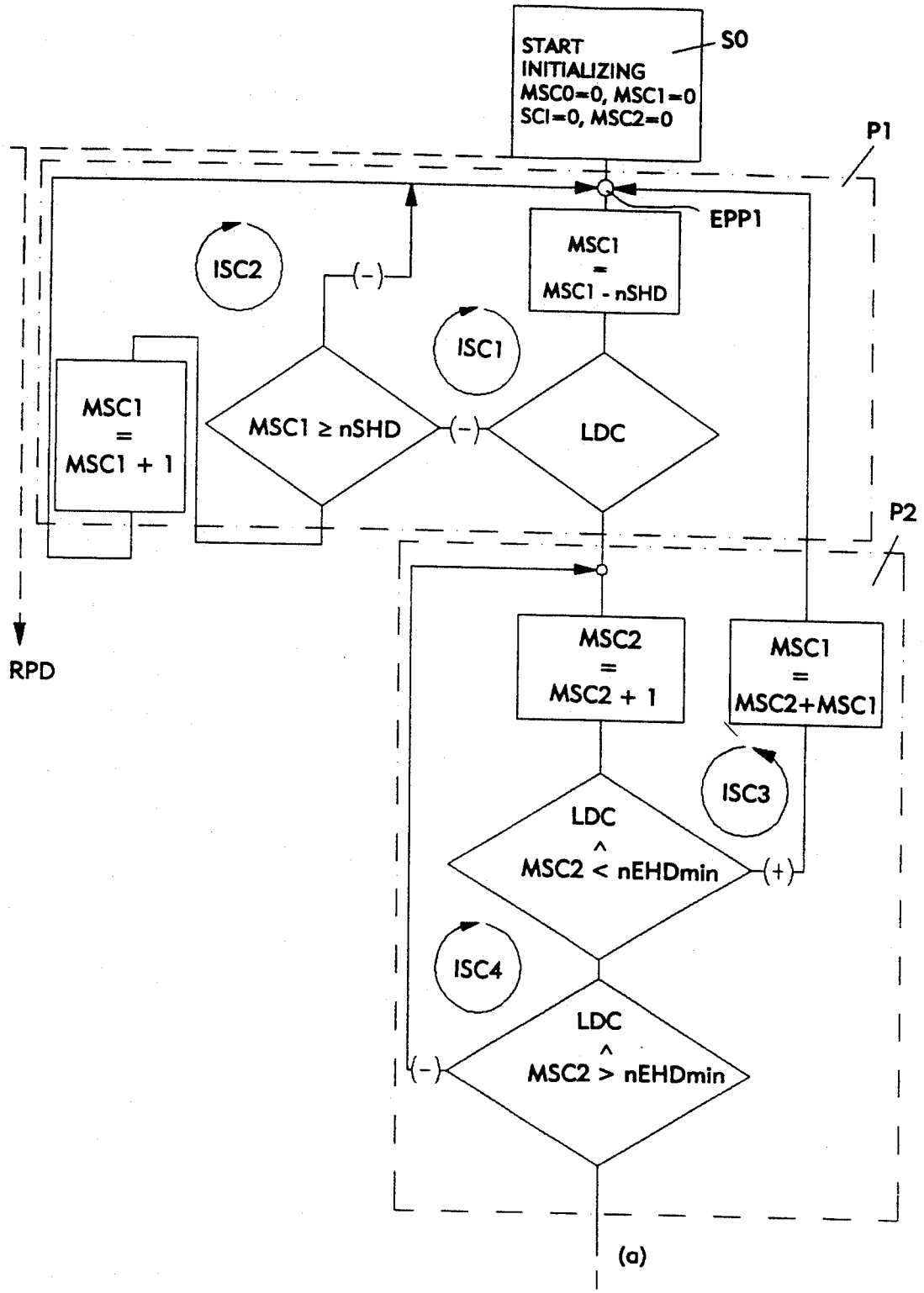
FIG. 5 shows a view of a first flow diagram for the paper correction according to FIG. 2.

In one state P0 in FIG. 5, several counters and storage cells, required for the paper correction PC, are initialized with a corresponding starting value prior to initiating the paper correction PC by the microprocessor 19. In this way, for example, the pointer PT is loaded in a counter MSC0, where the pointer PT gives the number of motor steps MS according to FIG. 3, which number of motor steps MS is required for the blockwise covering of the continuous form paper 10 with the respective edge perforation holes EH1 . . . EHv. In addition, further counters MSC1, MSC2 for the paper correction PC and a storage cell SC1 for the storage of the residual error RFm are initialized with a starting value "0".

According to one state P1 of the paper correction PC, in case of the reference point definition RPD, there is then subsequently determined the reference point RPm for the block Bm of the continuous form paper 10. The number of motor steps MS of the electromotor 14 is thereby determined by the counter MSC1 in an inquiry and scanning cycle ISC1 of the course diagram over an entry point position EPP1 up to the predetermined number nSHD of motor steps MS of the set perforation hole distance SHD, at which number of motor steps MS the optical scanner 17, moving relative to the continuous form paper 10, recognizes a dark - light change DLC. If there is mention in the following of an entry point position, then this refers to the position where the side branch of the inquiry and scanning cycle joins the main branch. The dark - light change DLC thereby corresponds to the message of the optical scanner 17 that a paper - perforation hole change of the continuous form paper 10 has occurred at the optical scanner 17.

If the optical scanner 17 in an inquiry and scanning cycle ISC2 signals no dark - light change DLC for the predetermined number nSHD of motor steps MS of the set perforation ho le distance SHD, for example, SHD:=MSC1=nSHD=60, then a covered first edge perforation hole EH1 is assumed. This covered first edge perforation hole EH1 is subsequently faded and blended out, in that the number nSHD of motor steps MS for the set perforation hole distance SHD is subtracted from the present content of the counter MSC1 and the search for the next edge perforation hole EH2 . . . EHz is subsequently continued.

If the optical scanner recognizes however the expected dark - light change DLC, then there is checked in a state P2 whether the recognized dark - light change DLC belongs to the edge perforation hole EH2 . . . EHz. During this verification, it is investigated with regard to the recognized edge perforation hole EH2 . . . EHz whether it is disposed within a valid tolerance region for the edge perforation hole diameter EHD of the edge perforation hole EH2 . . . EHz. The tolerance region comprises in this case a minimum edge perforation hole diameter EHDmin and a maximum edge perforation hole diameter EHDmax deviating from the edge perforation hole diameter EHD. A minimum - maximum inquiry (min-max-inquiry) is performed for the determination whether the recognized edge perforation hole EH2 . . . EHz is also disposed within the valid tolerance region, at which the minimum and maximum edge perforation hole diameters EHDmin, EHDmax are compared with the diameter of the recognized edge perforation hole EH2 . . . EHz. While the min-inquiry is performed during the state P2 of the paper correction PC, the max-inquiry is performed during the state P3 of the paper correction PC.

Initially, the number of motor steps MS is determined from the dark - light change DLC to a next light - dark change LDC by the counter MSC2 for the evaluation of the diameter of the recognized edge perforation hole EH2 . . . EHz in an inquiry cycle ISC3, ISC4. The light - dark change corresponds in this case to a perforation hole - paper change of the continuous form paper 10. If the expected light - dark change LDC occurs in the inquiry cycle ISC3 at a number of motor steps MS, corresponding to the counter state of the counter MSC2, which is smaller than the number of motor steps for the minimum edge perforation hole diameter EHDmin, then the edge perforation hole EH2 . . . EHz is invalid. An invalid edge perforation hole can for example be present where the continuous form paper 10 is ripped at the respective position in the region of the edge perforation. In order to be able to continue the search for a next edge perforation hole EH3 . . . EHz from the respective position, the counter state of the counter MSC2 is added to the counter state of the counter MSC1 and the reference point definition RPD is started anew at the entry point position EPP1 of the state P1 with the updated counter state for the counter MSC1.

However, if no light - dark change LDC has been signalled by the optical scanner 17 after the dark - light change DLC, then the inquiry cycle ISC4 is performed so long over an entry point position EPP2 until the counter state of the counter MSC2 exhibits a larger number of motor steps MS than the number of motor steps MS for the minimum edge perforation hole diameter EHDmin.

According to FIG. 5, no statement is made in the state P2 as to which course sequence occurs if the number of the motor steps MS, counted by the counter MSC2, coincides with the number of the motor steps MS for the minimum edge perforation hole diameter EHDmin. This special case can be taken into consideration either larger than EHDmin during the inquiry of the counter MSC2 or smaller than EHDmin during the inquiry of the counter MSC2.

Figure 6:
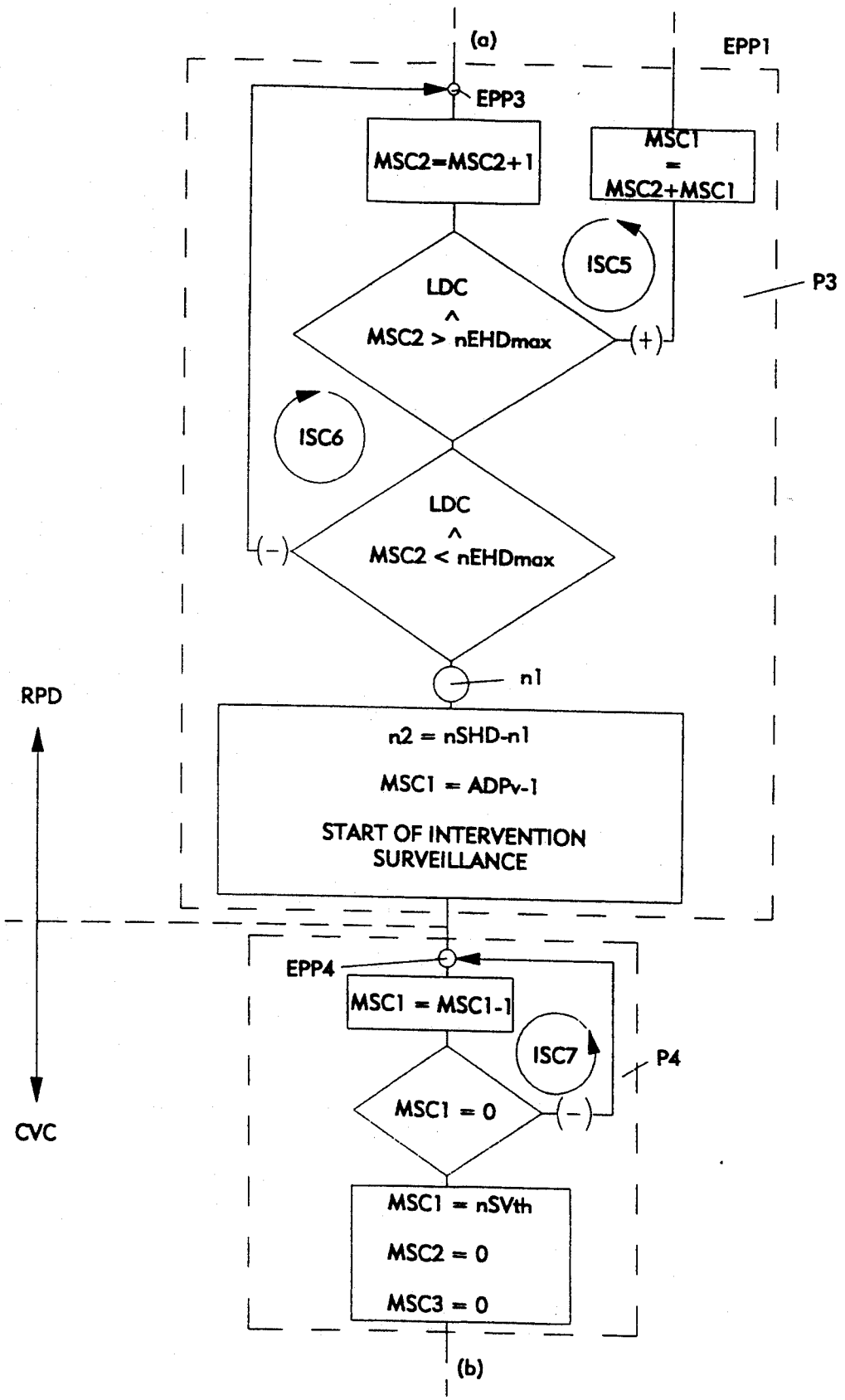
FIG. 6 shows a view of a second flow diagram for the paper correction according to FIG. 2.

Initially, the motor steps MS up to the expected light - dark change LDC are further counted by the counter MSC2 according to FIG. 6 for the max-inquiry in the state P3 during an inquiry cycle ISC5, ISC6. In the case that no light - dark change LDC is recognized and a path distance of the continuous form paper 10 has already been covered, which is larger than the maximum edge perforation hole diameter EHDmax, then the edge perforation hole EH3 . . . EHz is again invalid. In order to allow that the search for the next edge perforation hole EH4 . . . EHz can continue from the respective position, the counter state of the counter MSC1 is updated by the counter state of the counter MSC2.

On the other hand, if a path distance of the continuous form paper 10 has been covered, which is smaller than the maximum edge perforation hole diameter EHDmax, then the search for the light - dark change LDC is continued through an entry point position EPP3 in an inquiry cycle ISC6.

If the expected light - dark change LDC has finally taken place and if this change is disposed within the tolerance region for the edge perforation hole diameter EHD, then the edge perforation hole EH4 . . . EHz, recognized in the state P1, is found for the reference point definition RPD of the paper correction PC. The actual counter state of the counter MSC1 thereby indicates a number n1 of motor steps MS of the electromotor 14 according to FIG. 1, by way of which number the distance from the starting position SPm of the block Bm in case of the paper correction PC to the reference point RPm is indicated at the upper edge of the edge perforation hole EH4 . . . EHz, recognized in the state P1. In order to be able to take into consideration the already covered distance during the residual error collection REC of the paper correction PC, the reference point RPm of the block Bm, determined by the number n1, is shifted into the upper edge of the last edge perforation hole EHv of the preceding block Bm−1. This is accomplished in that the number n1 of the motor steps MS for the covering of the path distance from the starting position SPm of the block Bm during the paper correction PC to the upper edge of the recognized edge perforation hole EH4 . . . EHz is subtracted from the number nSHD of motor steps MS for the set perforation hole distance SHD. The therefrom resulting number n2 is stored by the microprocessor 19 and holds up to further notice as standard for the paper correction PC.

Figure 13:
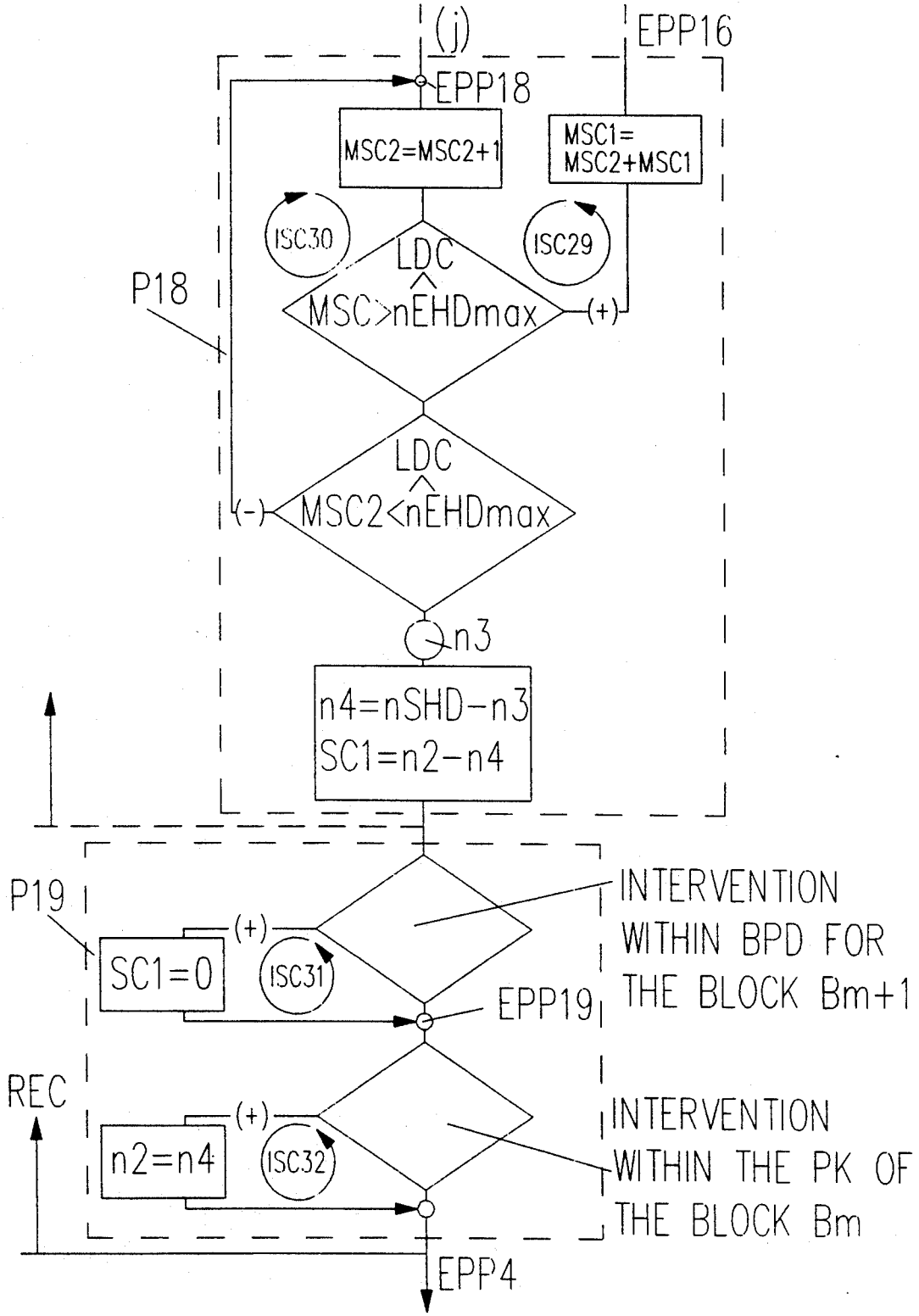
FIG. 13 shows a view of a ninth flow diagram for the paper correction according to FIG. 2.
Figure 14:
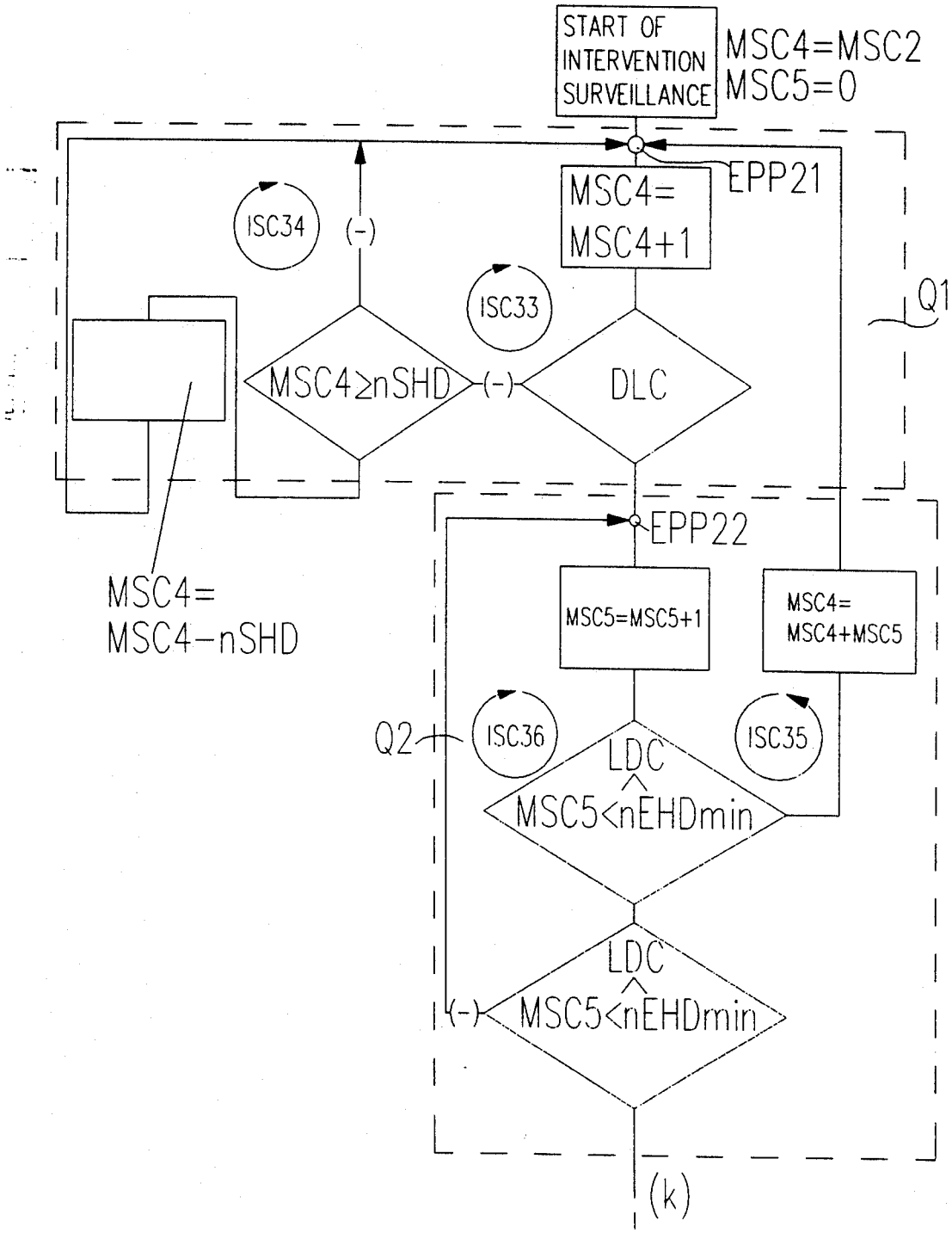
FIG. 14 shows a view of a first schematic flow diagram for an intervention surveillance according to FIG. 2.

The counter MSC1 is preloaded with an actual distance pointer ADPv−1, the intervention surveillance IS is started according to the representation in FIGS. 13 and 14, and the therefor necessary starting values are initialized with termination of the reference point definition RPD for the paper correction PC prior to entering the correction value collection CVC in a state P4 of the paper correction PC.

The actual distance pointer ADPv−1 provides thereby according to FIG. 3 the number of motor steps MS, which are necessary in order to move the continuous form paper 10 from the position, determined by the counter state of the counter MSC1, to a first starting point StPv−1 for the correction value collection CVC relative to the optical scanner 17. The actual distance pointer ADPv−1 is determined in that the counter state of the counter MSC1, indicating the actual position of the continuous form paper 10 versus the optical scanner 17, is subtracted from the set distance pointer SDPv−1. The first starting point StPv−1, determined by the set distance pointer SDPv−1, defines with a first end point EPv−1 the first theoretical evaluation window EWv−1, in which the next to last edge perforation hole EHv−1, as selected for the correction value collection CVC, of the block Bm of the continuous form paper 10 is suspected.

In order to be able to correct positioning errors, occurring during the positioning of the continuous form paper 10 in the print position PP of the printing device 1 according to FIG. 1, the edge perforation hole EHv−1, selected for the correction value collection CVC, should if possible be disposed at the end of the block Bm of the continuous form paper 10. The deviation between the actual position and the set position of the continuous form paper 10 is thereby collected over the entire length of the block Bm up to the remaining residual error REm. There results thereby a first slippage value SVv−1 relative to the next to last edge perforation hole EHv−1, wherein the first slippage value SVv−1 forms together with the residual error REm a correction value.

In order to further improve the relationship of the slippage value SVv−1 relative to the residual error REm, the last edge perforation hole EHv is also taken into consideration for the correction value collection CVC. The edge perforation hole EHv delivers a second slippage value SVv, where the second slippage value SVv together with the residual error REm forms a further correction value. In order to be able to provide the distance of the last edge perforation hole EHv from the starting position SPm, a set distance pointer SDPv is defined according to FIG. 3, by way of which a second starting point StPv of the block Bm for the correction value collection CVC is set. The second starting point StPv defines with a second end point EPv the second theoretical evaluation window EWv in which the last edge perforation hole EHv is suspected.

The set distance pointer SDPv−1, SDPv is a function of the length of the block Bm and of the theoretical evaluation window EWv−1, EWv. All undesired influences during the paper correction PC are taken into consideration in the theoretical evaluation window EWv−1, EWv. For example, apparatus tolerances and scanning tolerances are counted among these influences.

The continuous form paper 10 is initially moved by the distance path, predetermined by the actual distance point ADPv−1, in the transport direction TD according to FIG. 3 during the correction value collection CVC. For this purpose, the counter MSC1, preloaded with the actual distance pointer ADPv−1, is decreased in an inquiry cycle ICS7 through an entry point position EPP4 by 1 during each motor step MS of the electromotor 14. If the counter state of the counter MSC1=0 or, respectively, if the path distance, corresponding to the actual distance pointer ADPv−1, has been covered after several courses and running of the inquiry cycle ISC7, then the counter MSC1 is in the following entered with a number nSVth of motor steps MS for a theoretical slippage value SVth as well as the counter MSC2 and a further counter MSC3 is entered with a starting value "0".

Figure 7:
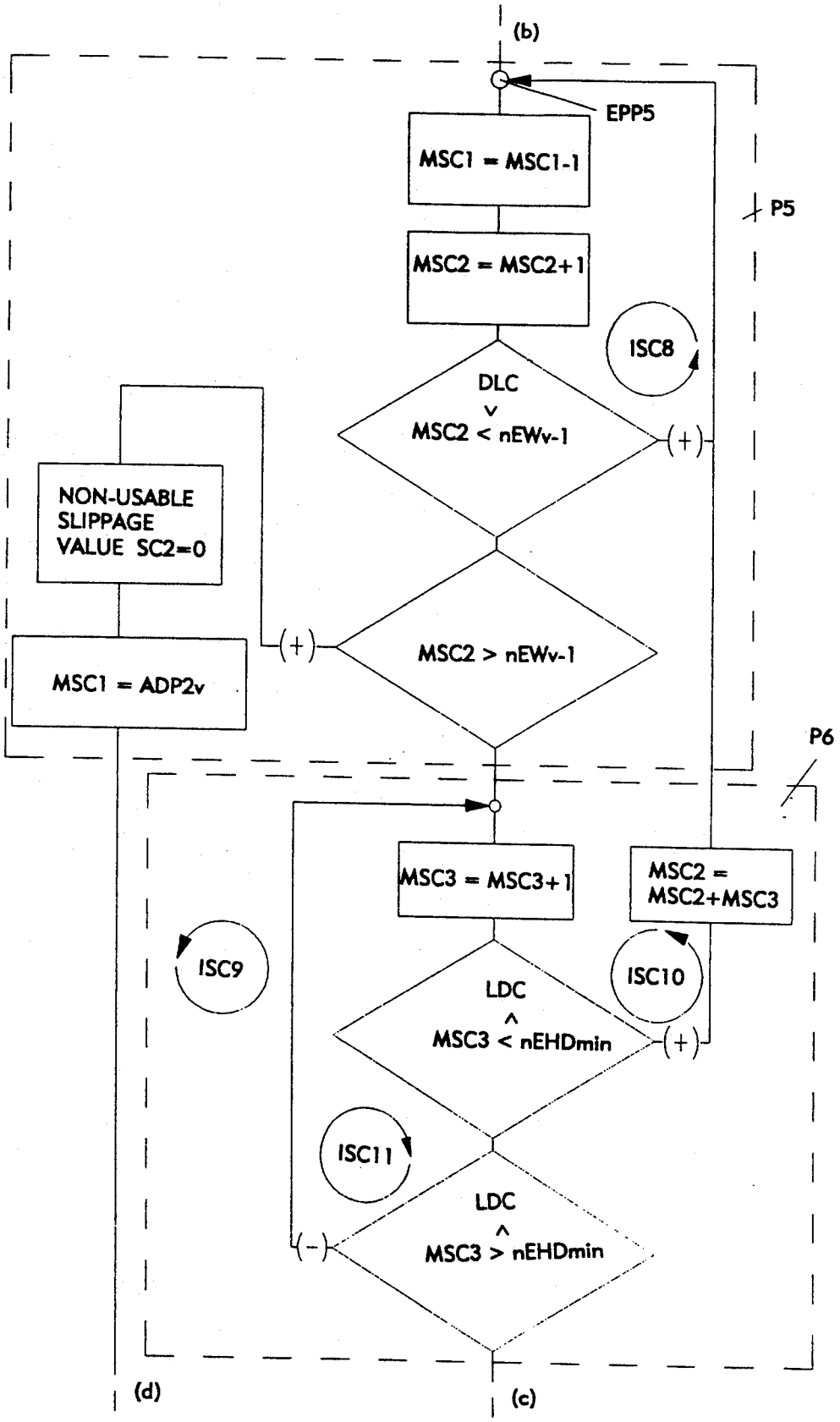
FIG. 7 shows a view of a third flow diagram for the paper correction according to FIG. 2.

According to FIG. 7, there is subsequently searched in a state P5 of the paper correction PC for a dark - light change DLC within the theoretical evaluation window EWv−1. For this purpose, the counter state of the counter MSC1 is initially decreased by 1 and the counter state of the counter MSC2 is increased by 1 in an inquiry cycle ISC8, whereby a motor step MS of the electromotor 14 is performed. If the optical scanner 17 signals after this motor step MS no dark - light change DLC, then the counter state of the counter MSC1 is decreased by 1 through an entry point position EPP5 of the inquiry cycle ISC8, the counter state of the counter MSC2 is increased by 1, and the search for the dark - light change DLC is continued. If the search for the dark - light change DLC within the theoretical evaluation window EWv−1 remains without success, if for example the next to last edge perforation hole EHv−1 of the block Bm is covered, or a dark - light change DLC occurred, wherein however the determined slippage value SVv−1 is larger than the permissible slippage value SVth, then the next to last edge perforation hole EHv−1 is marked as not usable in an inquiry cycle ISC9 and no slippage value SVv−1 is stored in a storage cell SC2. Furthermore, a slippage value SVv−1 is also not stored if the counter state of the counter MSC2 is larger than the number nEWv−1 of motor steps MS for the running through of the theoretical evaluation window EWv−1 during an occurring dark - light change DLC. It is also possible to declare the search as unsuccessful already if the counter state of the counter MSC2 is equal to the number nEWv−1. In the last analysis, this depends on the question which tolerance values have been admitted during the correction value collection CVC.

If no slippage value SVv−1 has been stored in the inquiry cycle ISC9, then the counter MSC1 is entered with an actual distance pointer ADP2v and the second slippage value SVv is determined through an entry point position EPP8 of the inquiry cycle ISC9 in the state P8 of the paper correction PC. The actual distance pointer ADP2v results according to FIG. 3 in that the sum from the set distance pointer SDPv−1 and the number nEWv−1 of motor steps MS for the theoretical evaluation window EWv−1 is subtracted from the set distance pointer SDPv. The actual distance pointer ADP2v provides thereby the number of motor steps MS which are necessary in order to pass from the first end point EPv−1 for the correction value collection CVC to the second starting point StPv for the correction value collection CVC.

If however in the state P5 of the paper correction PC the dark - light change DLC is recognized within the theoretical evaluation window EWv−1, then it is checked, as in the case of the dark - light change DLC in the state P1, if the next to last edge perforation hole EHv−1, belonging to the dark - light change DLC, is disposed with respect to its diameter EHD in the valid tolerance region.

Initially, the counter state of the counter MSC3 is increased by 1 for the min-inquiry in a state P6 within an inquiry cycle ISC10, ISC11, and the continuous form paper 10 is thereby moved by a motor step MS of the electromotor 14 in the transport direction TD. If a light - dark change LDC is then signalled by the optical scanner 17 in the inquiry cycle ISC10 and if the counter state of the counter MSC3 corresponds to a number of motor steps MS, which is smaller than the number nEHDmin of motor steps MS of the minimum edge perforation hole diameter EHDmin, then the counter state of the counter MSC2 is updated by the counter state of the counter MSC3 and the correction value collection CVC is continued through the entry point position EPP5 of the state P5.

This inquiry cycle ISC10 is run through for such a time until the counter state of the counter MSC2 indicates a number of motor steps MS, which is larger than the number nEWv−1 of motor steps MS for the first theoretical evaluation window EWv−1. Then, again no slippage value SVv−1 is present and the course sequence is again continued through the entry point position EPP8 in the state P8 of the paper correction PC after the counter MSC1 has been entered with the actual distance pointer ADP2v.

If however no light - dark change LDC is indicated by the optical scanner 17 and if the counter state of the counter MSC3 is smaller than the number nEHDmin of motor steps MS for the covering of the minimum edge perforation hole diameter EHDmin, then the counter state of the counter MSC3 is increased by 1 in the inquiry cycle ISC11 through an entry point position EPP6 until the counter state of the counter MSC3 indicates a number of motor steps MS, which is larger than the number nEHDmin of motor steps MS of the minimum edge perforation hole diameter EHDmin.

Figure 8:
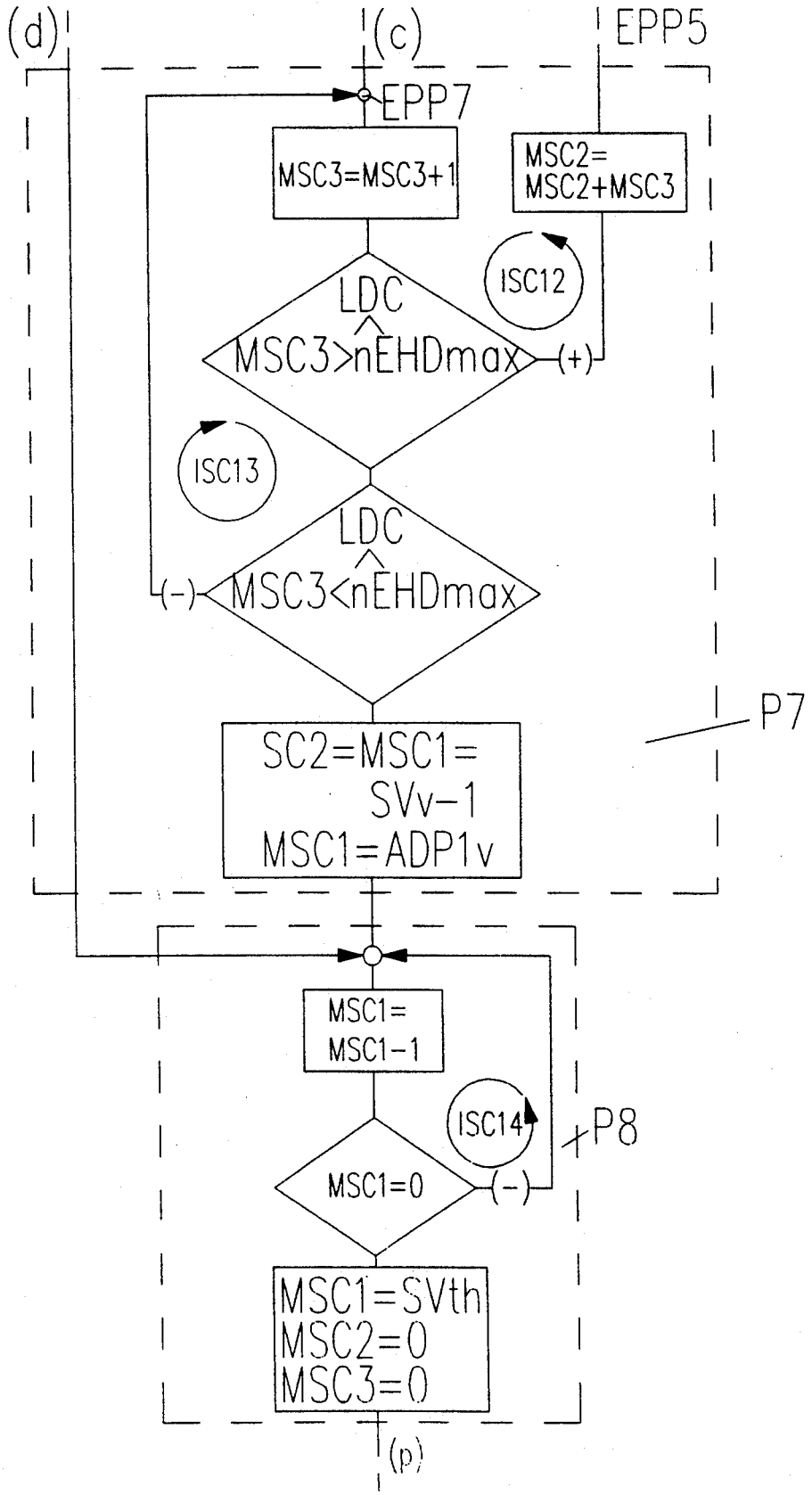
FIG. 8 shows a view of a fourth flow diagram for the paper correction according to FIG. 2.

According to FIG. 8 the counter state of the counter MSC3 is now initially increased by 1 during an inquiry cycle ISC12, ISC13 for the max-inquiry occurring in a state P7 of the paper correction PC and thereby the continuous form paper 10 is moved further by a motor step MS of the electromotor 14. If then no light - dark change LDC is recognized by the optical scanner 17 in the inquiry cycle ISC12 and if the counter state of the counter MSC3 corresponds to a number of motor steps MS, which is larger than the number nEHDmax of motor steps for the covering of the maximum edge perforation hole diameter EHDmax, then the counter state of the counter MSC2 is updated by the counter state of the counter MSC3 and the correction value collection CVC is continued over the entry point position EPP5 of the state P5. This inquiry cycle ISC12 is run through for such time until the counter state of the counter MSC2 indicates again, as it occurred in connection with the min-inquiry in the state P6, a number of motor steps MS, which is larger than the number mEWv−1 of motor steps MS for the first theoretical evaluation window EWv−1. Then, again there is no slippage value SVv−1 present and the course sequence is continued again through the entry point position EPP8 in the state P8 of the paper correction PC after the counter MSC1 has been entered with the actual distance pointer ADP2v.

If however the optical scanner 17 has signalled the expected light - dark change LDC and if the counter state of the counter MSC3 is larger than the number nEHDmax of motor steps MS for the covering of the maximum edge perforation hole diameter EHDmax, then the counter state of the counter MSC3 is increased by 1 in the inquiry cycle ISC13 through an entry point position EPP7 until the counter state of the counter MSC3 indicates a number of motor steps MS which is smaller than the number nEHDmax of motor steps MS of the maximum edge perforation hole diameter EHDmax.

Now the expected, next to last edge perforation hole EHv−1 for the correction value collection CVC is present and the counter state of the counter MSC1 is stored in the storage cell SC2. The stored value is the slippage value SVv−1. The slippage value SVv−1 is in this case by definition not smaller than the negative theoretical slippage value −SVth and not larger than the positive theoretical slippage value +SVth. The sign of the slippage value SVv−1 indicates thereby in which direction the continuous form paper 10 has to be corrected during the correction execution CE of the paper correction PC. After the storing of the slippage value SVv−1, the counter MSC1 is entered with the actual distance pointer ADP1v.

The counter state of the counter MSC1 is now again decreased by 1 in the state P8 of the paper correction PC, analogously to the state P4, during each motor step MS of the electromotor 14 in an inquiry cycle ISC14 through the entry point position EPP8 in the case that the path distance, preset by the actual distance pointer ADP1v for the transport of the continuous form paper 10, has not been covered. If after covering the path distance, provided by the actual distance pointer ADP1v, the second starting point StPv for the correction value collection CVC is reached at the beginning of the second theoretical evaluation window EWv, then the counter MSC1 is again entered with the theoretical slippage value SVth as well as the counter MSC2, MSC3 are initialized with the starting value "0".

Figure 9:
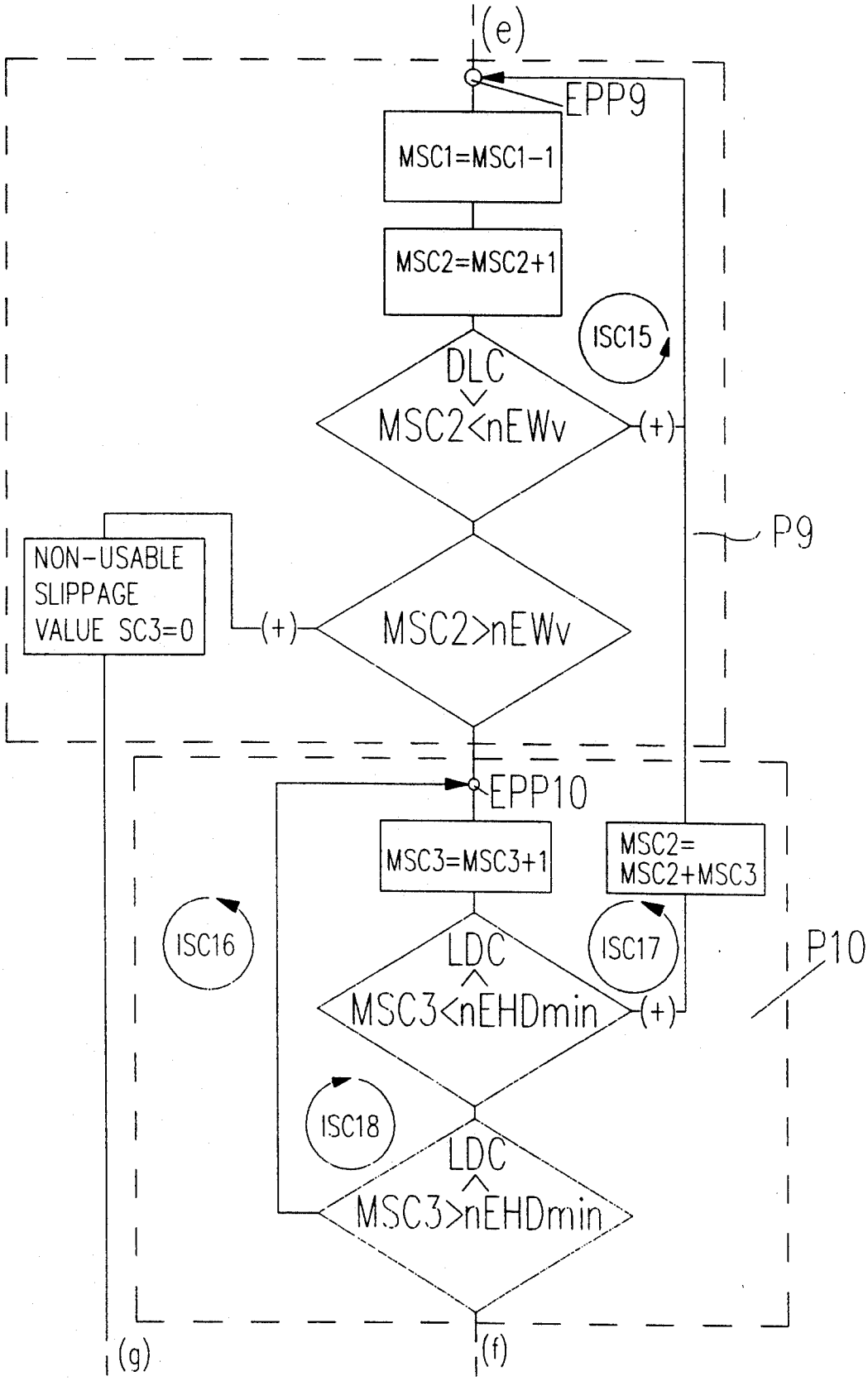
FIG. 9 shows a view of a fifth flow diagram for the paper correction according to FIG. 2.

According to FIG. 9 there is investigated following thereto in a state P9 of the paper correction PC, as in the state P5, whether a dark - light change DLC is recognized by the optical scanner 17 in the second theoretical evaluation window EWv. For this purpose, the counter state of the counter MSC1 is initially decreased by 1 and the counter state of the counter MSC2 is increased by 1 in an inquiry cycle ISC15. If the inquiry with regard to the dark - light change DLC is negative and if the counter state of the counter MSC2 is smaller than a number nEWv of motor steps MS for the second theoretical evaluation window EWv, then the inquiry cycle ISC15 is run anew through an entry point position EPP9.

If no dark - light change DLC occurs also after the covering of the number nEWv of motor steps MS within the second theoretical evaluation window EWv, i.e. when the counter state of the counter MSC2 is larger than the number nEWv of motor steps MS for the second theoretical evaluation window EWv, then the expected last edge perforation hole EHv is marked as not usable in an inquiry cycle ISC16 and thus no valid second slippage value SVv is stored in a storage cell SC3. The correction value collection CVC is then terminated in this case and the procedure of the paper correction PC transfers into the correction execution CE immediately through an entry point position EPP12 in a state P12.

Figure 10:
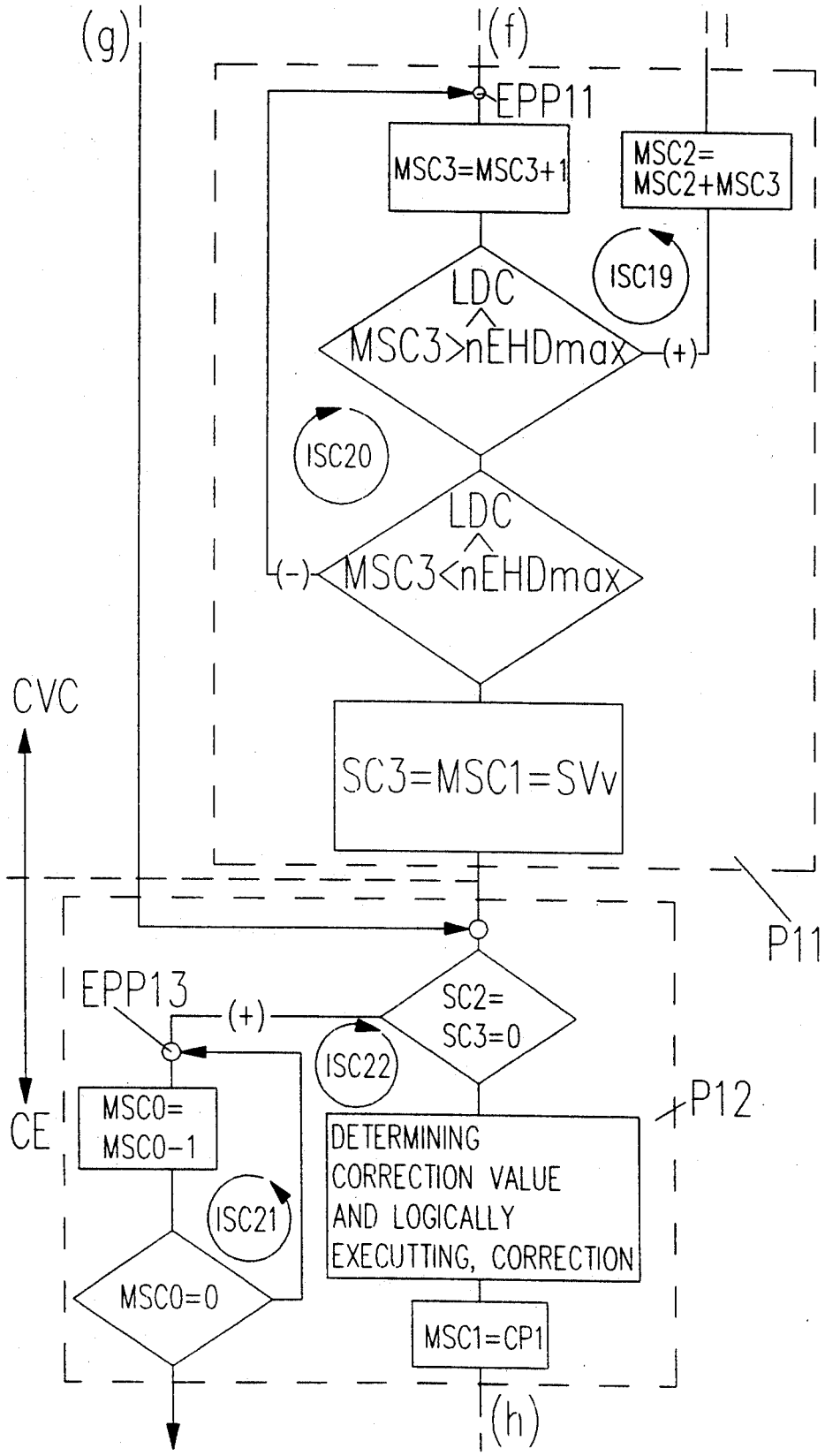
FIG. 10 shows a view of a sixth flow diagram for the paper correction according to FIG. 2.

If however the dark - light change DLC is determined by the optical scanner 17 in the state P9 of the paper correction PC, then, analogously to the state P6, P7, a min-inquiry or, respectively, a max-inquiry is performed in a state P10, P11 of the paper correction PC according to FIG. 10. Instead of the entry point positions EPP5, EPP6, EPP7 for the inquiry cycles ISC10 . . . ISC13, entry point positions EPP9, EPP10, EPP11 for the inquiry cycles ISC17 . . . ISC20 are now employed. If the counter state of the counter MSC1 is not smaller than the negative theoretical slippage value −SVth and also not larger than the positive theoretical slippage value +SVth at the end of the state P11, then the counter state is stored in the storage cell SC3. The stored value represents the slippage value SVv. The correction value collection CVC of the paper correction PC is terminated with the two stored slippage values SVv−1, SVv.

It is however also possible to determine more than two slippage values during the correction value collection CVC. This increases the probability that a valid slippage value could be determined.

Initially, the slippage values SVv−1, SVv, determined during the correction value collection CVC, are evaluated during the correction execution CE occurring now in the state P12. If no valid slippage value SVv−1, SVv was stored in the storage cells SC2, SC3 during the correction value collection CVC, i.e. SC2=SC3=0, then initially the counter state of the counter MSC0 is decreased by 1 in the following in an inquiry cycle ISC21. If in this case the pointer PT has not been covered or, respectively, the end of the block Bm has not been reached, then the inquiry cycle ISC21 is run through an entry point position EPP13 until the counter state of the counter MSC0 indicates the value 0 and thus the end of the block Bm has been reached. The counters MSC0, MSC1, MSC2, given in the state P0, and the storage cell SC1 are initialized anew with the there indicated starting value with the covering of the path distance for the block Bm of the continuous form paper 10 during an inquiry cycle ISC22 and the reference point definition RPD for the next following block Bm+1 is started through the entry point position EPP1.

If however during the correction value collection CVC a valid slippage value SVv−1 or, respectively, SVv has been determined for the next to last edge perforation hole EHv−1 as well as for the last edge perforation hole EHv of the block Bm, then the position of the continuous form paper 10 is being corrected. The correction value, forming the basis for the correction, results from the respective present slippage value SVv−1, SVv and a residual error REm−1 for the case that one of the two slippage values SVv−1, SVv is available for the correction execution CE. The residual error REm−1 results in this case, analogously to the residual error REm, from the paper correction of the continuous form paper 10.

In the case that both slippage values SVv−1, SVv are valid, then the slippage value SVv has the higher priority versus the slippage value SVv−1 and the correction value results from the residual error REm−1 and the slippage value SVv. The residual error REm−1 represents a correction value which was obtained during the paper correction PC of the block Bm−1. The residual error REm−1, determined there during the residual error collection REC, is stored for the paper correction PC of the block Bm, and the residual error REm is stored for the paper correction PC of the block Bm+1, etc. in the storage cell SC1.

After the correction value is determined, the correction is initially performed on the logical plane and the correction is prepared on the physical plane.

The correction on the logical plane is performed in that the pointer PT is changed by the corresponding correction value. The counter MSC1 is entered in the state P12 with a correction pointer CP1 for the preparation of the correction on the physical plane, wherein the correction pointer CP1 results from the difference between the correction pointer CP and the actual counter state of the counter MSC3. The correction pointer CP1 indicates in this case by how many motor steps MS the continuous form paper 10 has to be moved from its actual position in order that the physical correction starts at the point in time when the path distance, indicated by the correction pointer CP, has been covered.

Figure 11:
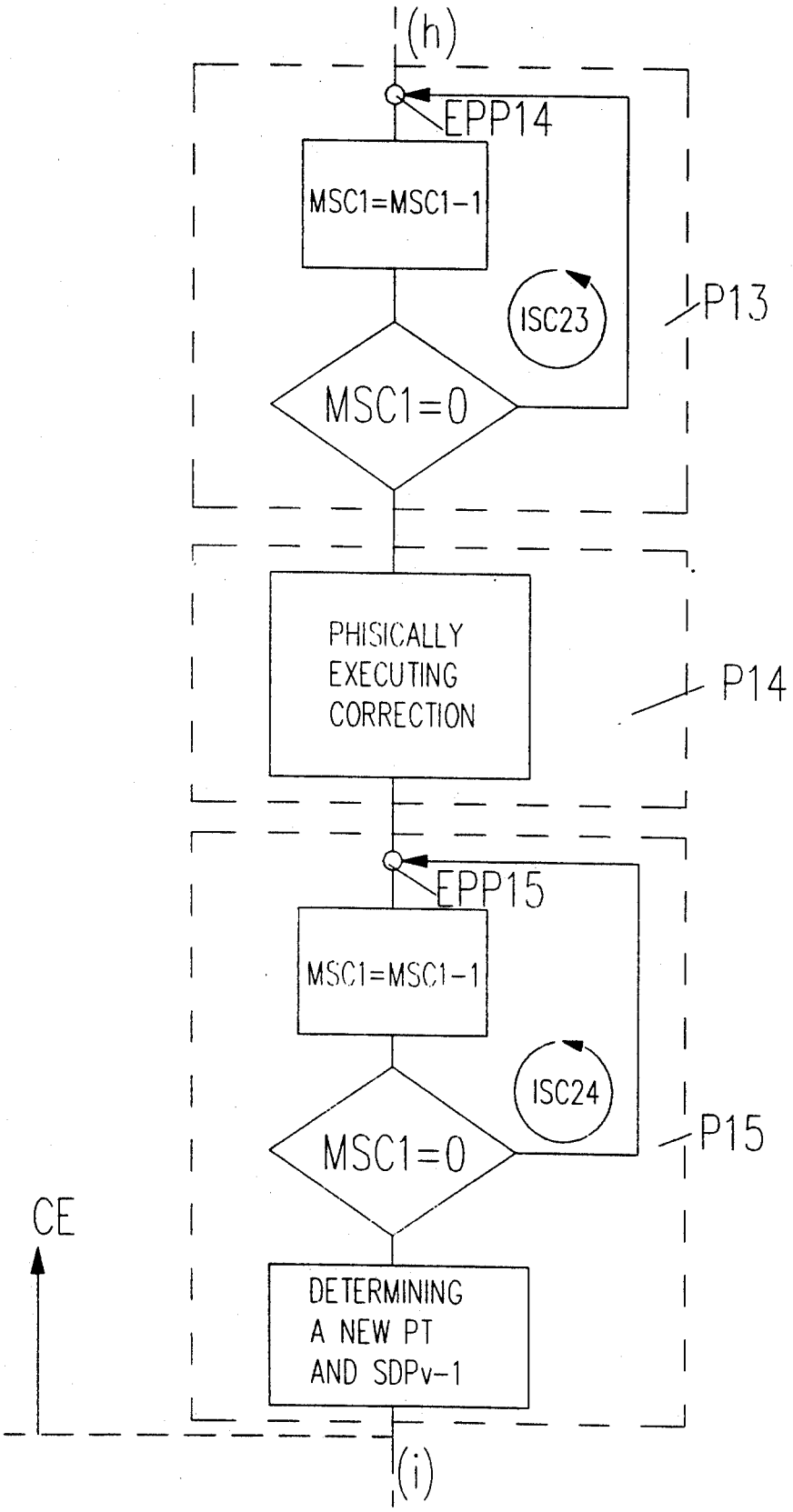
FIG. 11 shows a view of a seventh flow diagram for the paper correction according to FIG. 2.

According to FIG. 11, this point in time is reached in a state P13 of the paper correction PC precisely when the counter state of the counter MSC1, preloaded with the correction pointer CP1, in an inquiry cycle ISC23 is decreased by 1 through an entry point position EPP14 for each motor step MS of the electromotor 14 for such a time until the counter state of the counter MSC1=0. Following thereto, the correction is performed physically in a state P14 of the paper correction PC.

First it is in general attempted during the physical correction to incorporate the number of motor steps MS, provided corresponding to the correction value, in whole or in part into the actual advance command for the continuous form paper 10. If this should not be completely possible, then immediately an internal correction command is generated and started for the residual remainder of the correction value at the end of the actual advance command for the continuous paper 10. The advance command for the continuous form paper 10 is accepted only after the complete correction has been performed.

Before the residual error collection REC can now be performed after termination of the correction execution CE of the paper correction PC, the continuous form paper 10 according to FIG. 3 is moved in a state P15 of the paper correction PC in the transport direction TD for such a time until the end of the block Bm is reached at the starting position SPm+1 for the next following block Bm+1. The counter state of the counter MSC0, preloaded with the pointer PT, as in the inquiry cycle ISC21 of the state P12, is decreased by 1 in an inquiry cycle ISC24 through an entry point position EPP15 for such time until the counter MSC0 indicates the value 0. In conclusion, the pointer PT and the actual distance pointer SDPv−1 are set anew for the position surveillance or, respectively, position evaluation of the continuous form paper 10 in the state P15 of the paper correction PC.

Figure 12:
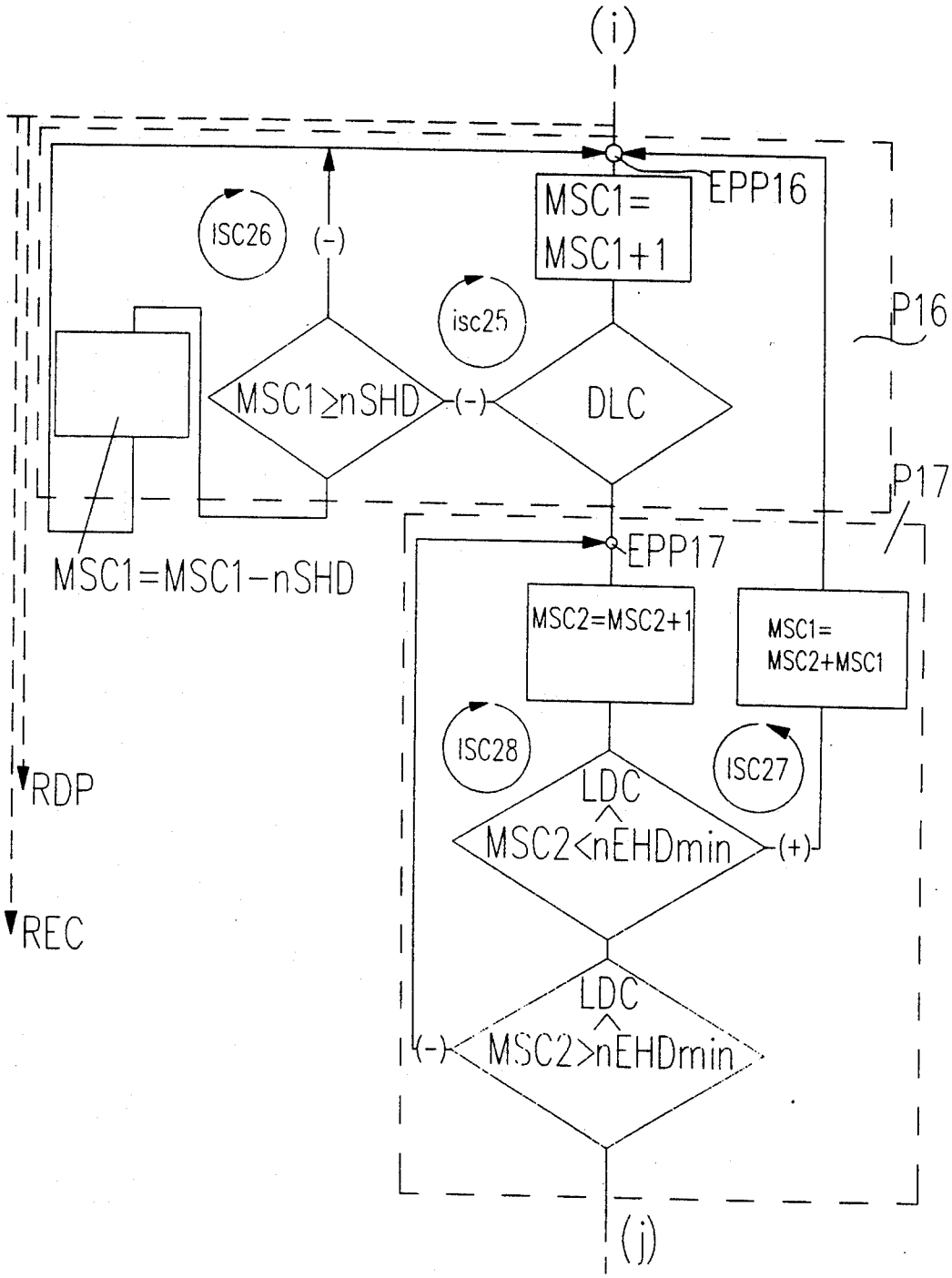
FIG. 12 shows a view of an eighth flow diagram for the paper correction according to FIG. 2.

Initially, the reference point definition BDP for the block Bm+1 is performed in states P16, P17, P18 of the paper correction PC with the starting of the residual error collection REC according to FIGS. 12 and 13. The reference point definition RPD is distinguished relative to the reference point definition RPD in the states P1, P2, P3 only in the numbering of the inquiry cycles and of the entry point positions. In this case there are considered inquiry cycles ISC25 . . . ISC30 and entry point positions EPP16, EPP17, EPP18 instead of the inquiry cycles ISC1 . . . ISC6 and the entry point positions EPP1, EPP2, EPP3. The counter state of the counter MSC1 indicates a number n3 of motor steps MS of the electromotor 14 at the end of the reference point definition RPD for the block Bm+1, by way of which there is indicated the distance from the starting position SPm+1 of the paper correction PC for the block Bm+1 to the reference point RPm+1 at the upper edge of the edge perforation hole EH1 . . . EHz, recognized in the state P16. The reference point RPm+1 of the block Bm+1, determined by the number n3, is shifted in the upper edge of the last edge perforation hole EHv of the preceding block Bm for the residual error collection REC. This is achieved by subtracting the number n3 of motor steps MS from the number nSHD of motor steps for the set perforation hole distance SHD. The therefrom resulting number nU is subtracted from the number n2 for the determination of the residual error REm. In order that the residual error REm can be taken into consideration during the paper correction PC of the block Bm+1 of the continuous paper 10, the residual error REm is intermediately stored in the storage cell SC1 and the already stored residual error REm−1 is thereby extinguished.

The residual error collection REC of the paper correction PC is terminated in that a scanning or an inquiry is performed in a state P19 if an intervention within the reference point definition RPD for the block Bm+1 and within the paper correction PC for the block Bm has occurred. The two scannings or inquiries are in this case performed sequentially in the recited sequence.

If an intervention has occurred within the reference point definition RPD for the block Bm+1, then the storage cell SC1, in which the precedingly determined residual error REm is stored, is extinguished during an inquiry cycle ISC31, and an inquiry for the intervention within the paper correction PC is performed through an entry point position EPP19.

If however no intervention has occurred, then this inquiry is performed immediately through the entry point position EPP19.

If an intervention has occurred within the paper correction PC, then the number n2 of motor steps MS, determined during the reference point definition RPD for the block Bm, from the starting position SPm to the upper edge of the last edge perforation hole EHv, is no longer taken into consideration by the block Bm−1 as standard in an inquiry cycle ISC32, but the number n4 determined during the reference point definition RPD for the block Bm+1. Subsequently, the paper correction PC of the block Bm+1 of the continuous form paper 10 is continued over an entry point position EPP20 and the entry point position EPP4. If however no intervention occurred within the paper correction PC, then the position surveillance or, respectively, the position evaluation of the block Bm+1 is performed immediately through the entry point position EPP20, EPP4.

Figure 15:
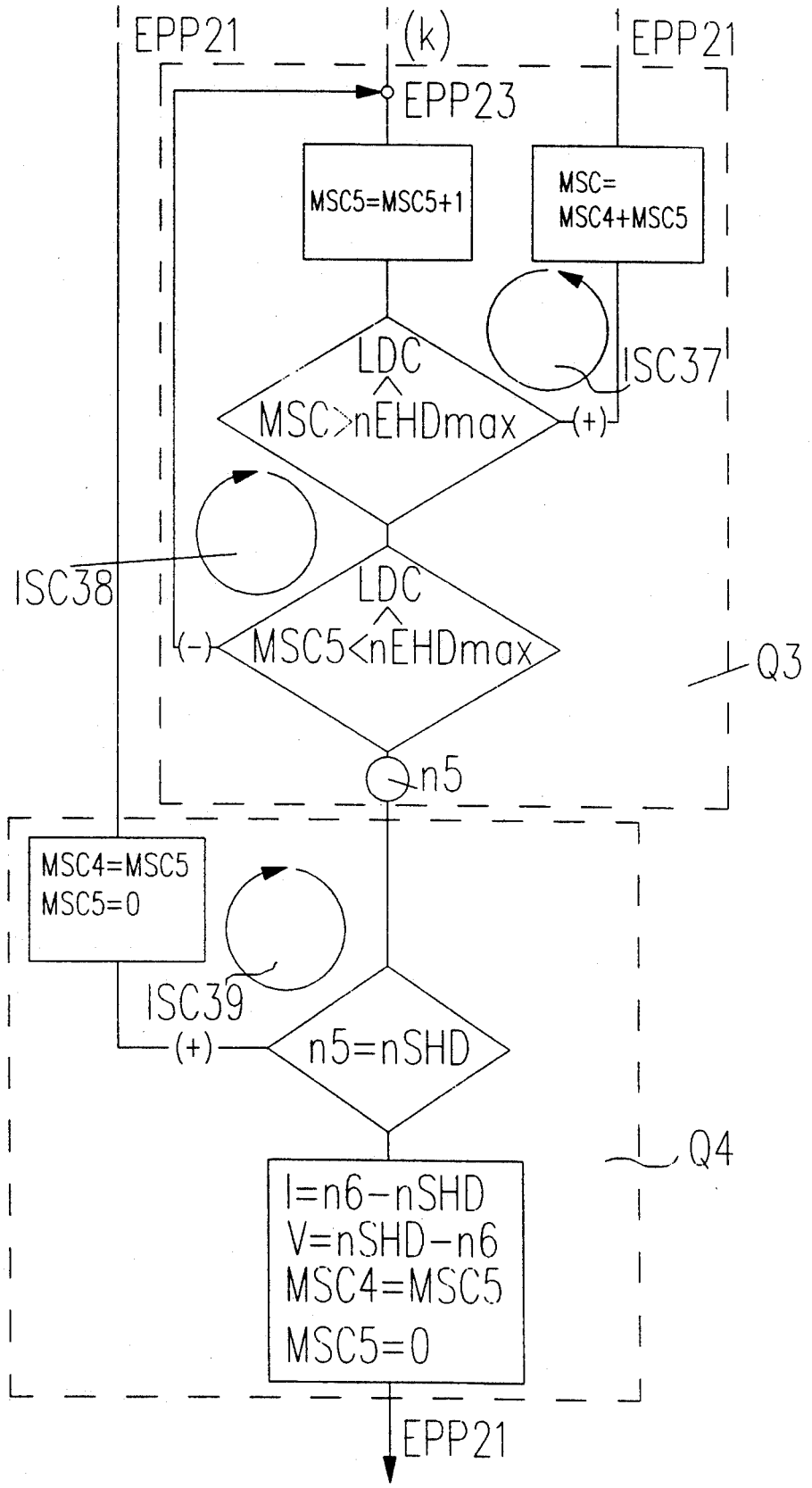
FIG. 15 shows a view of a second schematic flow diagram for an intervention surveillance according to FIG. 2.

A course diagram of the intervention surveillance IS is illustrated in FIGS. 14 and 15. Initially, a counter MSC4 is initialized with the counter content of the counter MSC2 and a counter MSC5 is initialized with the starting value "0" for the intervention surveillance IS which is started by the paper correction PC in the state P3. Subsequently thereto, and in a state Q1 of the intervention surveillance IS, the intervention recognition for the block Bm of the continuous form paper 10 is started. For this purpose, the number of the motor steps MS of the electromotor 14 is determined by the counter MSC4 in an inquiry cycle ISC33 of the course diagram for the intervention surveillance IS through an entry point position EPP21 until the optical scanner 17 recognizes a dark - light change DLC. The dark - light change DLC corresponds thereby to the message of the optical scanner 17 that a paper - perforation hole change of the continuous form paper 10 has occurred at the optical scanner 17.

If the optical scanner 17 signals no dark - light change DLC according to the inquiry cycle ISC34, for the preset number nSHD of motor steps MS, which corresponds to the set perforation hole distance SHD, then there is assumed a covered first edge perforation hole EH1, as in the case of the paper correction PC in the state P1. This covered first edge perforation hole is then faded or blended out by subtracting the number nSHD of motor steps MS for the set perforation hole distance SHD from the actual content of the counter MSC4, and the search for a valid edge perforation hole EH2 . . . EHv is then continued.

If the optical scanner 17 recognizes however, for example after a multiple passage of the inquiry cycle ISC34, in the state Q1 finally the expected dark - light change DLC, then it is checked in a state Q2 if the recognized dark - light change DLC belongs to the edge perforation hole EH2 . . . EHv. During this verification and testing, it is investigated for the recognized edge perforation hole EH2 . . . EHv if it is disposed within the valid tolerance region for the edge perforation hole diameter EHD of the edge perforation hole EH2 . . . EHv. The tolerance region comprises in this case the minimum edge perforation hole diameter EHDmin and the maximum edge perforation hole EHDmax, deviating from the edge perforation hole diameter EHD. As in the case of the paper correction PC, a min-max-inquiry is performed, whereby the minimum and maximum edge perforation hole diameter EHDmin, EHDmax are compared with the diameter of the recognized edge perforation hole EH2 . . . EHv for the determination if the recognized edge perforation hole EH2 . . . EHv is actually disposed within the valid tolerance region. While the min-inquiry is performed in the state Q2, the max-inquiry is performed in a state Q3 of the intervention surveillance IS.

During an inquiry cycle ISC35, ISC36, the number of motor steps MS from the dark - light change DLC to a next light - dark change LDC is determined by the counter MSC5 for the evaluation of the diameter of the recognized edge perforation hole EH2 . . . EHv. If the expected light - dark change LDC occurs in the inquiry cycle ISC35 with a number of motor steps MS, corresponding to the counter state of the counter MSC5, where the number of motor steps MS corresponding to the counter state is smaller than the number of motor steps MS for the covering of the minimum edge perforation hole diameter EHDmin, then the edge perforation hole EH2 . . . EHv is invalid. In order to allow the search for an edge perforation hole EH3 . . . EHv to continue from the respective position through the entry point position EPP21, the counter state of the counter MSC4 is updated by the counter state of the counter MSC5.

If however no light - dark change LDC is signalled by the optical scanner 17 after the dark - light change DLC, then the inquiry cycle ISC36 is run through an entry point position EPP22 for such time until the counter state of the counter MSC4 exhibits a larger number of motor steps MS than the number of motor steps MS for the covering of the minimum edge perforation hole diameter EHDmin. As in the state P2 of the paper correction PC, there is nothing expressed in the state Q2 of the intervention surveillance IS as to which course sequence occurs if the number of motor steps MS, counted by the counter MSC4, for the covering of the minimum edge perforation hole diameter EHDmin coincides with the number of motor steps MS for the covering of the minimum edge perforation hole diameter EHDmin. This special case can be taken into consideration either in the inquiry of the counter MSC4 'larger than EHDmin' or in the inquiry of the counter MSC4 'smaller than EHDmin'.

Initially, the motor steps MS are further counted up to the expected light - dark change LDC by the counter MSC4 according to FIG. 15 for the max-inquiry in the state Q3 with an inquiry cycle ISC37, ISC38. In the case that no light - dark change LDC is recognized and a path distance of the continuous form paper 10 has already been covered which is larger than the maximum edge perforation hole diameter EHDmax, then the edge perforation hole EH2 . . . EHv is again invalid. In order that the search for the next edge perforation hole EH3 . . . EHv can continue from the respective position, the counter state of the counter MSC4 is updated by the counter state of the counter MSC5.

If on the other hand a path distance of the continuous form paper 10 has been covered which is smaller than the maximum edge perforation hole diameter EHDmax, then the search for the light - dark change LDC is continued in the inquiry cycle ISC38 over an entry point position EPP23.

If the expected light - dark change LDC has finally occurred and if same is disposed within the tolerance region for the edge perforation hole diameter EHD, then based on the counter state of the counter MSC4 a statement can be made whether an intervention occurred during the paper correction PC. The actual counter state of the counter MSC4 indicates for this purpose the number n5 of motor steps MS of the electromotor 14 which are necessary in order to pass from the upper edge of an arbitrary edge perforation hole to the upper edge of the next following edge perforation hole. The question whether the intervention did occur during the paper correction PC can now be answered by that, in a state Q4 of the intervention surveillance IS, the number n5 of motor steps MS is compared with a number nSHD of motor steps for the set perforation hole distance SHD. If the determined number n5 coincides with the number nSHD of the set perforation hole distance SHD, then the counter state of the counter MSC5 is entered into the counter MSC4 in an inquiry cycle ISC39 and the intervention surveillance IS is continued over the entry point position EPP21 in the state Q1.

If however the number n5 is different from the number nSHD, then an intervention occurred into the paper correction PC. In case of the inquiry for an intervention, the investigation, if the number n5 of motor steps MS is within the tolerance region for the number nSHD of motor steps for the set perforation hole distance SHD, can be dispensed with, because this was already taken into consideration in the min-max-inquiry for the edge perforation hole diameter EHD.

The size of the intervention I is now determined in that the intervention is attributed to an intervention within the set perforation hole distance SHD and in that the number nSHD of motor steps MS for the covering of the set perforation hole distance SHD is subtracted from the therefrom resulting number n6. In order that the recognized intervention I can also be taken into consideration for the paper correction PC, the number n6 is subtracted from the number nSHD. The value V is obtained as a result and the set distance pointer SDPv−1 for the paper correction PC is reduced by said value. In order to be able to continue the intervention surveillance IS over the entry point position EPP21 in the state Q1, the counter state of the counter MSC5 is entered into the counter MSC4 and the counter MSC5 is initialized with the starting value "0".

It will be understood that each of the elements described above, or two or more together, may also find a useful application in other positioning methods for recording substrates differing from the types described above.

While the invention has been illustrated and described as embodied in the context of a method for the positioning of web-shaped recording substrates in printing devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for positioning web-shaped recording substrates in a printing device comprising employing web-shaped recording substrates including scannable elements, wherein the scannable elements are disposed at preset distances relative to each other;

moving the web-shaped recording substrate in the printing device;

guiding the scannable elements past a scanning device during a motion of the web-shaped recording substrate;

generating a scanning signal in the scanning device related to a motion of the scannable elements on the web-shaped recording substrate in the printing device;

collecting scanning results with means for collecting scanning results, wherein said means for collecting scanning results are connected to the scanning device;

collecting drive steps of the electromotor drive;

combining a plurality of scannable elements to form a signal block;

comparing the scanning results with preset values of an element storing reference points in a comparison device connected to the means for collecting scanning results;

determining corrections of positioning errors encountered with means for performing corrections connected to the comparison device and connected to an automatic control circuit of an electromotor-driven transport device for the web-shaped recording substrate;

quantizing corrections of positioning errors encountered at an end of a signal block with a residual error remaining in general;

correcting a position of the web-shaped recording substrate block by block with the automatic control circuit;

entering a residual error with proper sign into a subsequent correction procedure.

2. The method according to claim 1, wherein a blockwise automatic control occurs:

determining a reference position for blocks of the recording substrate;

collecting a position of at least one scannable element relative to the position of the scanning device at the beginning of an automatic position control of the recording substrate for each block;

collecting a position of at least one scannable element relative to the position of the scanning device for determining at least one set/actual position deviation of the recording substrate relative to a reference position of the signal blocks causing the positioning error;

determining a position of the recording substrate for the blocks depending on the set/actual position deviation of the recording substrate for correcting the position of the recording substrate;

performing a set/actual comparison of the respective, scanned path during a positioning of the recording substrate in the printing device;

shifting the reference position of the signal blocks during an automatic control of the position of the recording substrate;

cyclically collecting thereby the position of two scannable elements of the signal blocks of the recording substrate relative to the position of the scanning device for determining, setting, and considering interventions.

3. The method according to claim 2, further comprising searching a reference point indicating a position of the scannable element relative to a position of the scanning device at the beginning of the blockwise automatic position control of the recording substrate within a preset distance of the scannable elements starting with a first scannable element;

investigating if a tolerance region value of the scannable element is falling below or, respectively, surpassed based on a reference point of the scannable element being recognized within a preset distance by the scanning device; repeating the method steps of searching and investigating for the signal block depending of the results of investigating for such time until the tolerance region for the scannable elements is no longer falling below or, respectively, is no longer surpassed;

determining a relative shifting of the recording substrate relative to the scanning device at the beginning of the blockwise automatic position control of the recording substrate up to the reference point; and defining a reference position referring to the reference point for the case that the tolerance region for the scannable elements is no longer falling below or, respectively, is no longer surpassed.

4. The method according to claim 3, further comprising defining an upper edge of the scannable element as a reference point.

5. The method according to claim 4, further comprising moving a recording substrate relative to the printing device with a relative motion for determining the set/actual position deviation relative to the scanning device by a predetermined value from the reference position up to a starting point by theoretical evaluation windows into a transport direction of the recording substrate;

moving the recording substrate further from a starting point up to an end point into the transport direction relative to the scanning device;

searching a scannable element within a theoretical evaluation window;

comparing the relative shifting of the recording substrate relative to the scanning device with a theoretical set/actual position deviation.

6. The method according to claim 5, further comprising determining a set/actual position deviation for a last scannable element of the blocks;

employing the set/actual position in case of a presence of a plurality of set/actual position deviations for a correction of the position of the recording substrate.

7. The method according to claim 6, further comprising adding a residual error of the signal blocks, not considered in the set/actual position deviation and causing the position error, to the set/actual position deviation during the correction of the position of the recording substrate.

8. The method according to claim 7, further comprising determining a residual error of a signal block by comparing a relative shifting of the recording substrate relative to the scanning device for a subsequent signal block from a reference position to a reference point of the scannable elements with the relative shifting of the recording substrate relative to the scanning device for the signal block from a reference position to a reference point of the scannable elements.

9. A method for positioning web-shaped recording substrates (10) in a printing device (1), wherein the web-shaped recording substrates exhibit scannable elements (EH1 . . . EHz . . . EHv), disposed at preset distances relative to each other, wherein the scannable elements (EH1 . . . EHz . . . EHv) are guided past scanning devices (17) during motion of the web-shaped recording substrate (10), wherein the scanning devices (17) generate a scanning signal (SI), and wherein means are provided, which means collect the scanning results and correct positioning errors occurring by comparing the scanning results with preset values, by automatic control of the electromotor-driven transport device (11, 12) for the web-shaped recording substrate (10), wherein a) the drive steps of the electromotor drive (MS) are collected in addition to collecting the scannable elements (EH1 . . . EHz . . . EHv) on the web-shaped recording substrate (10), b) several scannable elements (EH1 . . . EHz . . . EHv) are combined to a block (B1 . . . , Bm . . . , Bv) and dependent thereon the correcting automatic control of the position of the web-shaped recording substrate (10) occurs blockwise, c) the correction of the occurred positioning error is performed quantized at the end of an actual block (B1 . . . Bm . . . Bv), such that a residual error (REm) can remain, which residual error (REm) is entered with proper sign into the subsequent correction procedure.

10. The method according to claim 9, wherein the blockwise automatic control occurs:

a) for determining a reference position (SP1 . . . SPm . . . SPu) for blocks (B1 . . . Bm . . . Bu) of the recording substrate (10), the position of at least one scannable element (EH1 . . . EHz) relative to the position of the scanning device (17) is collected at the beginning of the automatic position control of the recording substrate (10) for each block (B1 . . . Bm . . . Bu), b) for determining at least one set/actual position deviation (SVv−1, SVv) of the recording substrate (10) relative to the reference position (SP1 . . . SPm . . . SPu) of the blocks (B1 . . . Bm . . . Bu) causing the positioning error by capturing the position of at least one scannable element (EHv−1, EHv) relative to the position of the scanning device (17), c) for correcting the position of the recording substrate (10), by determining the position of the recording substrate (10) for the blocks (B1 . . . Bm . . . Bu) depending on the set/actual position deviation (SVv−1, SVv) of the recording substrate (10), d) for determining, setting,. and considering interventions (I), by cyclically collecting the position of two scannable elements (EH1 . . . EHv) of the blocks (B1 . . . Bm . . . Bu) of the recording substrate (10) relative to the position of the scanning device (17) by a set/actual comparison of the respective, scanned path during the positioning of the recording substrate (10) in the printing device (1) and by shifting the reference position (SP1 . . . SPm . . . SPu) of the blocks (B1 . . . Bm . . . Bu) during the automatic control of the position of the recording substrate (10).

11. The method according to claim 10, wherein a) at the beginning of the blockwise automatic position control of the recording substrate (10) within the preset distance (SHD) of the scannable elements (EH1 . . . EHz), starting with a first scannable element (EH1), a reference point (RP1 . . . RPm . . . RPu) is searched which indicates the position of the scannable element (EH1 . . . EHz) relative to the position of the scanning device (17), b) it is investigated from the reference point (RP1 . . . RPm . . . RPu) of the scannable element (EH1 . . . EHz), recognized within the preset distance (SHD) by the scanning device (17), if a tolerance region (EHDmin, EHDmax) of the scannable element (EH1 . . . EHz) is not reached or, respectively, surpassed, c) the method steps a) and b) for the block (B1 . . . Bm Bu) are repeated in dependency of the investigation results for such time until the tolerance region (EHDmin, EHDmax) for the scannable elements (EH1 . . . EHz) is no longer falling below or, respectively, is no longer surpassed, d) at the beginning of the blockwise automatic position control of the recording substrate (10) up to the reference point (RP1 . . . RPm . . . RPu) the relative shifting of the recording substrate (10) relative to the scanning device (17) is determined and thereby, for the case that the tolerance region (EHDmin, EHDmax) for the scannable elements (EH1 . . . EHz) is no longer falling below or, respectively, is no longer surpassed, the reference position (SP1 . . . SPm . . . SPu) referred to the reference point (RP1 . . . RPm . . . RPu) is defined.

12. The method according to claim 11, wherein the upper edge of the scannable element (EH1 . . . EHz . . . EHv) is defined as reference point (RP1 . . . RPm . . . RPu).

13. The method according to claim 12, wherein a) the recording substrate (10) is relatively moved with a relative motion for determining the set/actual position deviation (SVv−1, SVv) relative to the scanning device (17) by a predetermined value (SDPv−1, SDPv) from the reference position (SP1 . . . SPm . . . SPu) up to a starting point (StPv−1, StPv) by theoretical evaluation windows (EWv−1, EWv) into a transport direction (TD) of the recording substrate (10), b) a scannable element (EHv−1, EHv) is searched within the theoretical evaluation window (EWv−1, EWv) in that the recording substrate (10) is moved further from the starting point (StPv−1, StPv) up to an end point (EPv−1, EPv) into the transport direction (TD) relative to the scanning device (17), c) the relative shifting of the recording substrate (10) relative to the scanning device (17), determined in the evaluation window (EWv−1, EWv) up to recognition of the scannable element (EHv−1, EHv), is compared with a theoretical set/actual position deviation (SVth).

14. The method according to claim 12, wherein a set/actual position deviation (SVv), determined for a last scannable element (EHv) of the blocks (B1 . . . Bm . . . Bu), is taken into consideration in case of several present set/actual position deviations (SVv−1, SVv) for the correction of the position of the recording substrate (10).

15. The method according to claim 14, wherein a residual error (RE1 . . . REm . . . REu) of the blocks (B1 . . . Bm . . . Bu), not considered in the set/actual position deviation (SVv−1, SVv) and causing the position error, is added during the position correction of the recording substrate (10) to the set/actual position deviation (SVv−1, SVv).

16. The method according to claim 15, wherein a residual error (REm) of a block (Bm) is determined by comparison of the relative shifting of the recording substrate (10) relative to the scanning device (17) for a subsequent block (Bm+1) from a reference position (SPm+1) to a reference point (RPm, RPm+1) of the scannable elements (EH1 . . . EHz . . . EHv) with the relative shifting of the recording substrate (10) relative to the scanning device (17) for the block (Bm) from a reference position (SPm) to a reference point (RPm−1, RPm) of the scannable elements (EH1 . . . EHz . . . EHv).

17. A printing device including positioning of web-shaped recording substrates comprising a pin-feed tractor wheel having pins for engaging edge-perforated continuous paper including scannable elements and wherein the scannable elements are disposed at preset distances relative to each other;

a printer platen;

free-wheeling drive rollers disposed adjacent to the printer platen for forming a roller wedge for receiving edge-perforated continuous paper delivered by the pin-feed tractor wheel;

a scanning device disposed such that the guided edge-perforated continuous paper passes with the scannable elements past the scanning device during a motion of the edge perforated continuous paper;

a signal generator associated with the scanning device for generating a scanning signal related to a motion of the scannable elements on the edge-perforated continuous paper; means for collecting scanning results connected to the scanning device;

an electromotor powered drive;

an automatic control circuit connected to the electromotor powered drive;

means for collecting drive steps of the electromotor powered drive;

an element storing reference points;

means for forming a signal block by combining a plurality of scannable elements connected to the means for collecting scanning results;

a comparison device connected to the element storing reference points and to the means for forming a signal block for comparing scanning results with preset values of the element storing reference points;

means for performing corrections connected to the comparison device for determining corrections of positioning errors encountered for quantizing corrections of positioning errors encountered at an end of a signal block with a residual error remaining in general and connected to the automatic control circuit and for correcting a position of the edge-perforated continuous paper block by block through the automatic control circuit and for using a residual error with proper sign in a subsequent correction procedure.

* * * * *